United States Patent [19]

Hidassy

[11] 4,371,010

[45] Feb. 1, 1983

[54] BUNDLING TIE APPLYING TOOL

[75] Inventor: Laszlo Hidassy, Jamesburg, N.J.

[73] Assignee: Thomas & Betts Corporation, Raritan, N.J.

[21] Appl. No.: 203,687

[22] Filed: Nov. 3, 1980

[51] Int. Cl.[3] ..... B21F 9/02

[52] U.S. Cl. ..... 140/93 A; 140/93.2; 140/123.6

[58] Field of Search ..... 140/52, 53, 56, 57, 140/93 R, 93 A, 93.2, 123.6; 100/4, 6, 25, 26, 33 PB

[56] References Cited

U.S. PATENT DOCUMENTS

| | | | |
|---|---|---|---|
| 3,391,440 | 7/1968 | Harms | 29/203 |
| 3,438,406 | 4/1969 | Rozmus | 140/93.2 |
| 3,515,178 | 6/1970 | Hidassy | 140/123.6 |
| 3,633,633 | 1/1972 | Countryman | 140/93.2 |
| 3,799,214 | 3/1974 | Countryman | 140/93.2 |
| 3,891,012 | 6/1975 | Bakermans | 140/93 A |
| 3,946,769 | 3/1976 | Caveney et al. | 140/93.2 |
| 3,976,108 | 8/1976 | Caveney et al. | 140/93 A |
| 4,119,124 | 10/1978 | Collier et al. | 140/93.2 |
| 4,178,973 | 12/1979 | Collier et al. | 140/123.6 |

*Primary Examiner*—Lowell A. Larson

*Attorney, Agent, or Firm*—Robert M. Rodrick; Salvatore J. Abbruzzese; Jesse Woldman

[57] ABSTRACT

A power-operated tool for automatically applying a bundling tie to a plurality of wires or the like comprises an elongate rotatable tie carrier and a loading mechanism disposed adjacent thereto for positioning ties on the carrier. The loading mechanism is adapted to receive ties individually in succession from a series of ties that are webbed together head to head and to transfer the interconnected ties laterally to the carrier. A pawl is included for rotatably indexing the tie carrier to advance the ties positioned thereon to a separating station whereat the web between the heads is cut to thereby provide separated, individual ties. The ties are further advanced to a feeding position whereat an individual tie is positioned about the articles in a closed loop. A gripper is provided to tension the tie about the articles and a severing mechanism is included to suitably sever a strap portion at a predetermined tie tension.

50 Claims, 39 Drawing Figures

BUNDLING TIE APPLYING TOOL

FIELD OF THE INVENTION

This invention relates to the field of bundling a plurality of wires or other articles and, more particularly, to a power-operated installation tool for applying a bundling tie about a bundle of wires or the like.

BACKGROUND OF THE INVENTION

Plastic bundling ties are commonly used for bundling wires in electrical harnesses or other applications where a plurality of wires extending parallel to and adjacent each other are to be bundled. These ties are typically of the type having an elongate, thin, flexible strap and an apertured head adapted for passage of the tail end of the strap therethrough. The head includes means for engaging the strap to hold the bundling tie tightly in position about the wires.

Power-operated tools for automatically applying bundling ties are generally known. Such tools typically include means for positioning a bundling tie about the wires, tensioning the tie and then severing the strap once the tie is suitably tensioned. Typically, ties are fed into tools of this type from a disposable cartridge or magazine which holds the ties in a radially extending arcuate pattern. Such cartridges are commonly mounted directly on the tool although in one other arrangement the cartridge is disposed remote from the tool and individual ties are driven through an interconnecting hose by pneumatic pressure. In these tools using cartridge feeding devices, a plurality of individual ties are held in the cartridge and a suitable mechanism is required to transfer ties individually to the guide path of the tool positioning means.

In another known arrangement that utilizes a tie feeding mechanism without a cartridge, a tool includes a chamber for receiving and holding a plurality of individual ties arranged in a stack wherein the straps are in overlapping relation and the apertured heads are staggered in a straight row. The ties are held in place relative to each other by releasable, snap-fitting means on each of the ties for holding adjacent ties together.

In an automatic bundling tie applying tool, there are many features that are desirable, such as, for example, tie application speed, handleability, weight, ease and simplicity of tie loading, consistency of tie tensioning and portability. Each of the known application tools suffers from one or more limitations that reduce its desirability and effectiveness. For example, in tools having the arcuate cartridges mounted thereon, handling and control of the tool is difficult and awkward. In the tool with the remote dispenser, the application range is limited by the length of the hose interconnecting the tool and the dispenser. In the tool using the overlapping stacked ties, special preparation for tie alignment and loading is required. In the known various automatic tools the power is commonly furnished by fluid actuated means that requires a supply of fluid, typically under compression, thereby limiting the portability of the tools. Accordingly, a tool without such various limitations is therefore desirable.

SUMMARY OF THE INVENTION

It is an object of the present invention to provide an improved tool for applying bundling ties.

It is another object of the present invention to provide a power-operated bundling tie applying tool capable of portable operation.

In accordance with the invention, an apparatus is provided for applying to a plurality of articles to be bundled an elongate, flexible bundling tie having a head and a strap portion from a succession of such bundling ties interconnected between adjacent heads by a web. The apparatus includes a housing and means supported thereon for receiving ties individually from the succession of interconnected ties. Means are included for advancing the ties from the receiving means to a separating station whereat means are included for cutting the web between the tie heads to thereby provide separated, individual ties. The apparatus comprises means for positioning an individual tie in a closed loop about the articles and means for tensioning the tie thereabout.

In accordance with one form of the apparatus, a power-operated tool includes an electric motor for automatically operating the tool. A rotatable tie carrier is provided, preferably in the form of an elongate, generally cylindrical drum having a plurality of longitudinally extending slots thereon for holding individually the ties thereon. The drum is rotatably indexed to the cutting station and then to a feeding station where the individual ties are positioned for feeding the tie to a position adjacent the articles to be bundled. In the preferred arrangement, a reciprocable member driven axially along a continuously rotating shaft, feeds the tie to the application end of the tool. In such an arrangement, the means for rotatably indexing the drum and the means for cutting the interconnecting tie web are responsive to the movement of the reciprocable member for actuation.

In accordance with another preferred form of the invention, the power-operated tool includes means for holding a feed of interconnected ties on the tool for transfer thereto. Preferably, the feed is held in an accessible compartment on the tool for supplying the ties in succession to a loading mechanism adjacent the rotatable carrier means.

The invention is described by way of example with reference to the accompanying drawing figures.

Figure 8:
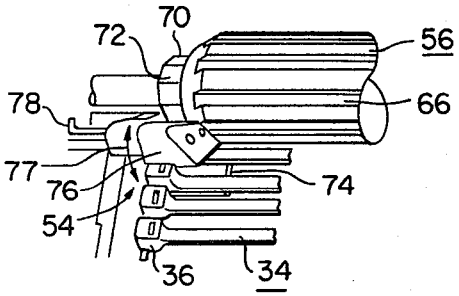
FIG. 8 is a fragmentary perspective view showing the loading of ties onto the rotatable tie carrier.
Figure 8A:
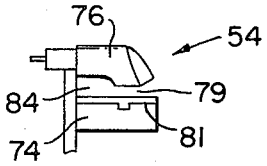

FIG. **8*a* is a side elevational view of the tie loading mechanism of FIG. 8**.

Figure 9:
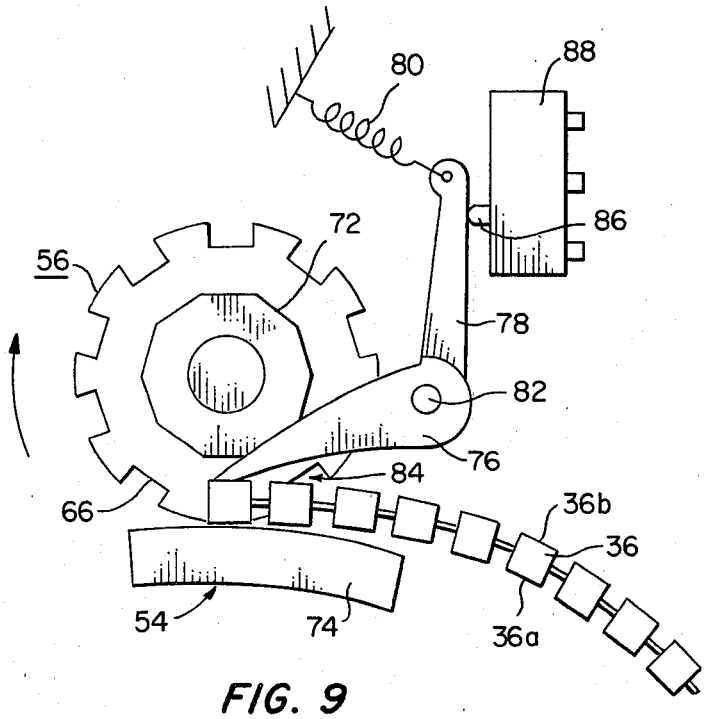

FIG. 9 is a diagrammatic view illustrating a preferred form of the tie loading mechanism.

Figure 1:
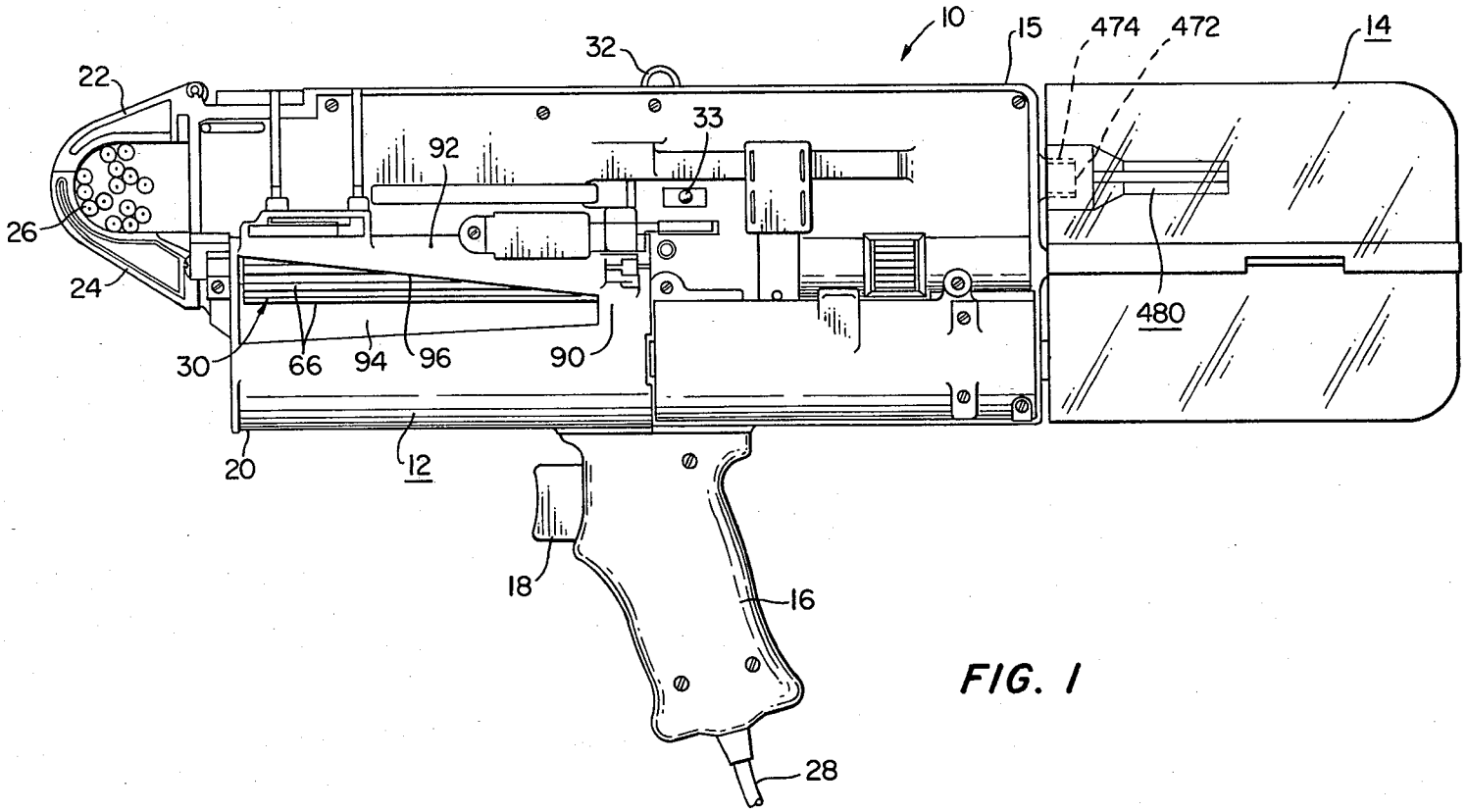
FIG. 1 is a side elevational view of a power-operated, automatic bundling tie applying tool according to the invention.
Figure 10:
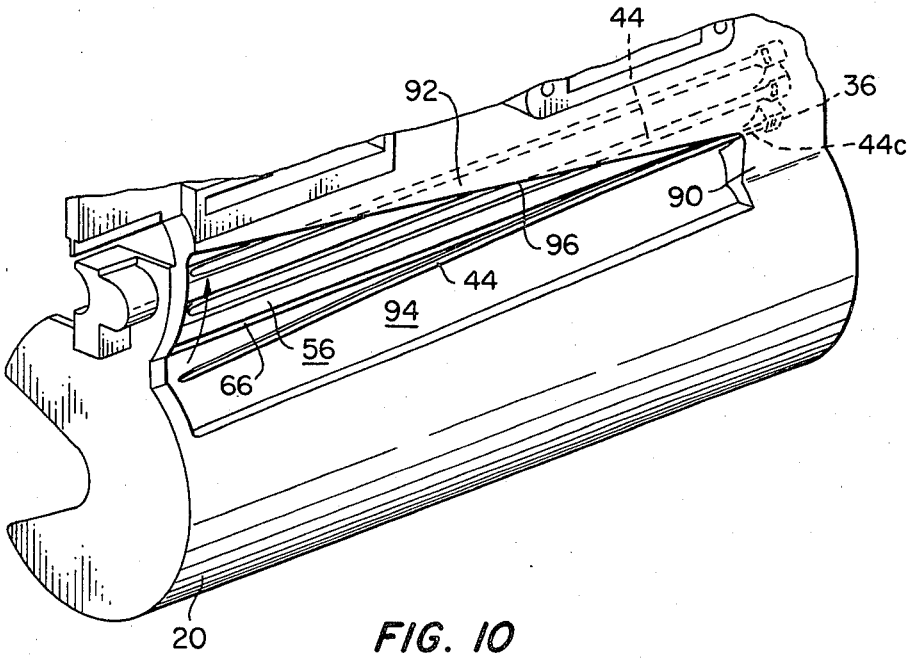

FIG. 10 is a fragmentary perspective view of the left front side of the tool of FIG. 1 showing preferred features for locating and holding ties in the tie carrier grooves during rotation.

Figure 11:
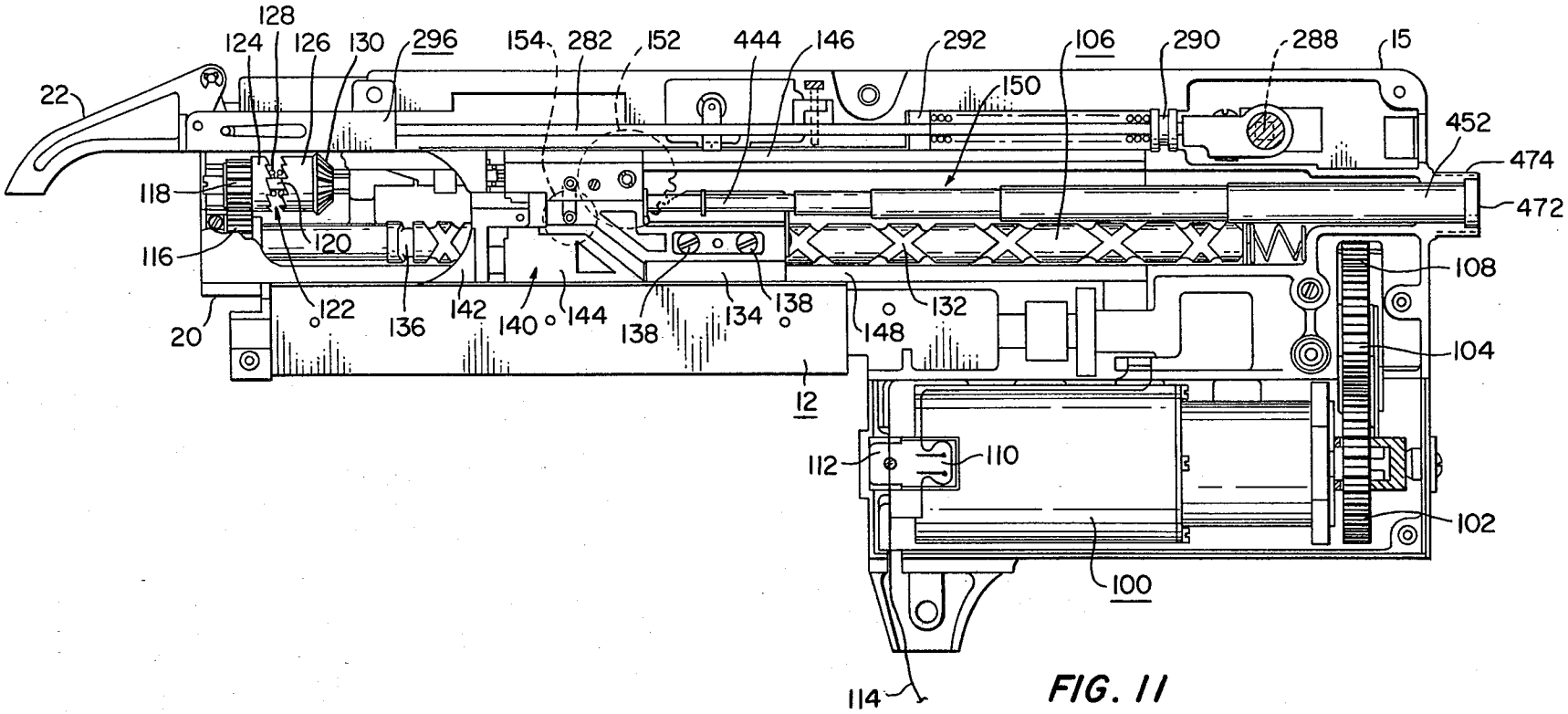

FIG. 11 is a side elevational view of the tool of FIG. 1 with the left side of the tool housing removed to expose the internal tool mechanisms supported on the housing right side.

Figure 12:
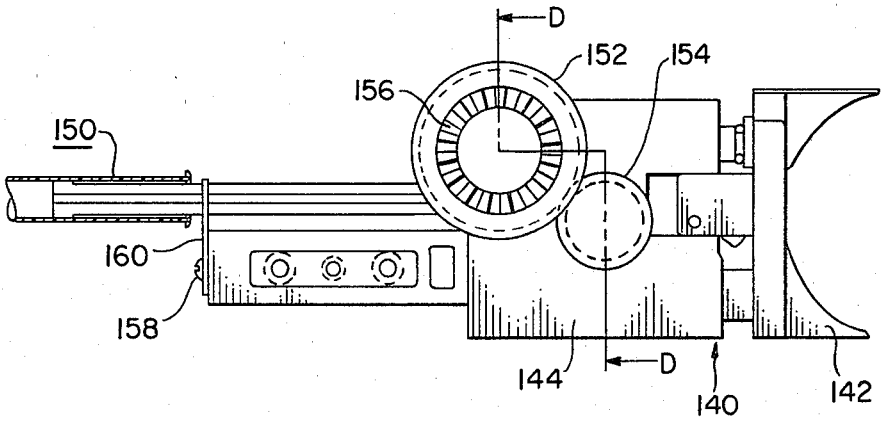

FIG. 12 is a side elevational view of the tie feeding mechanism of FIG. 11 as viewed from the side opposite that shown in FIG. 11.

Figure 13:
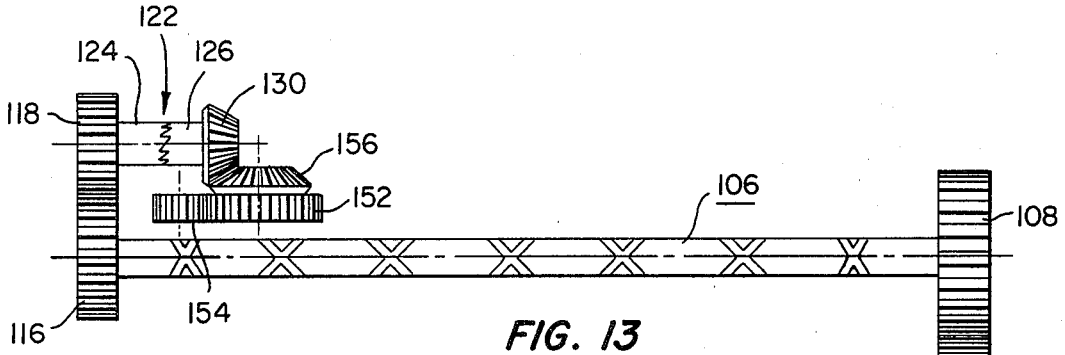

FIG. 13 is a diagrammatic illustration of the power drive mechanism of the tool.

Figure 14A:
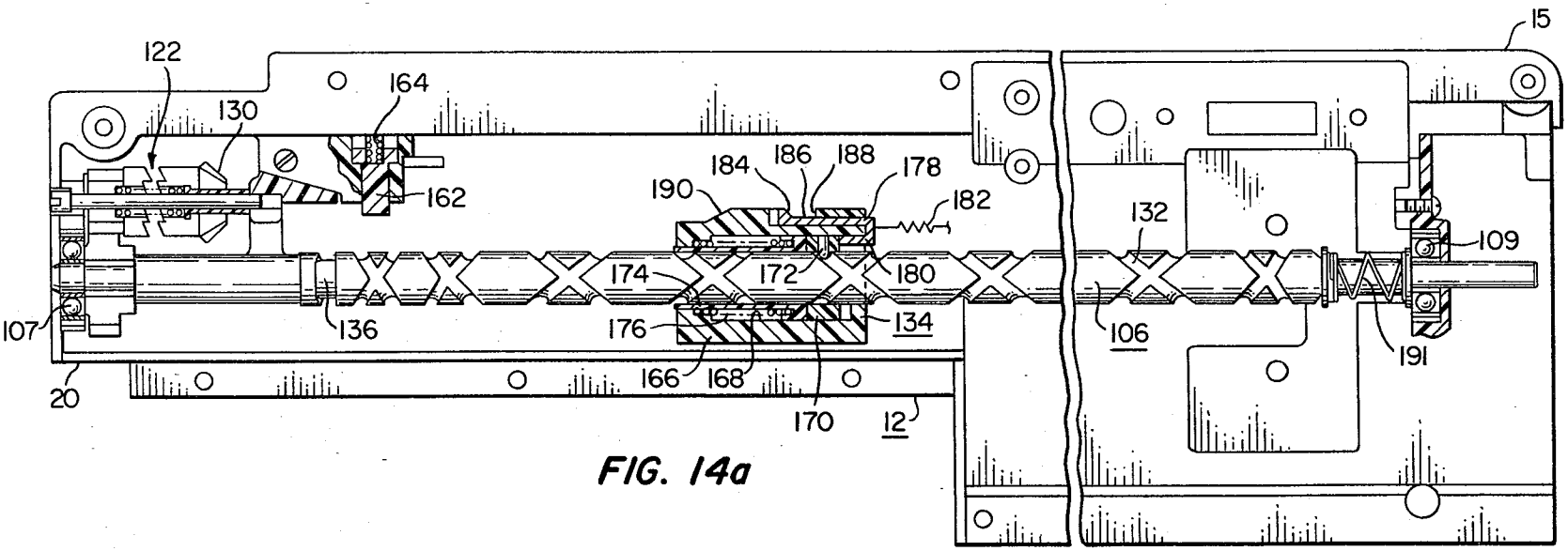

FIG. 14*a* is a side elevational view of a reciprocable carriage of the present invention axially moving along a rotary shaft.

Figure 14B:
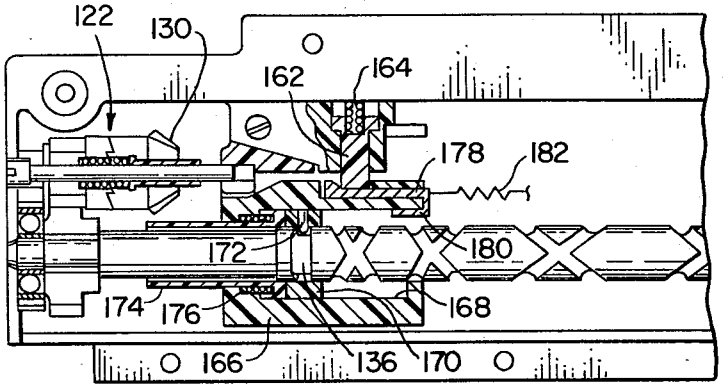

FIG. 14*b* is a partial view of the front end of FIG. 14*a* showing the reciprocable carriage in a releasably locked position.

Figure 3:
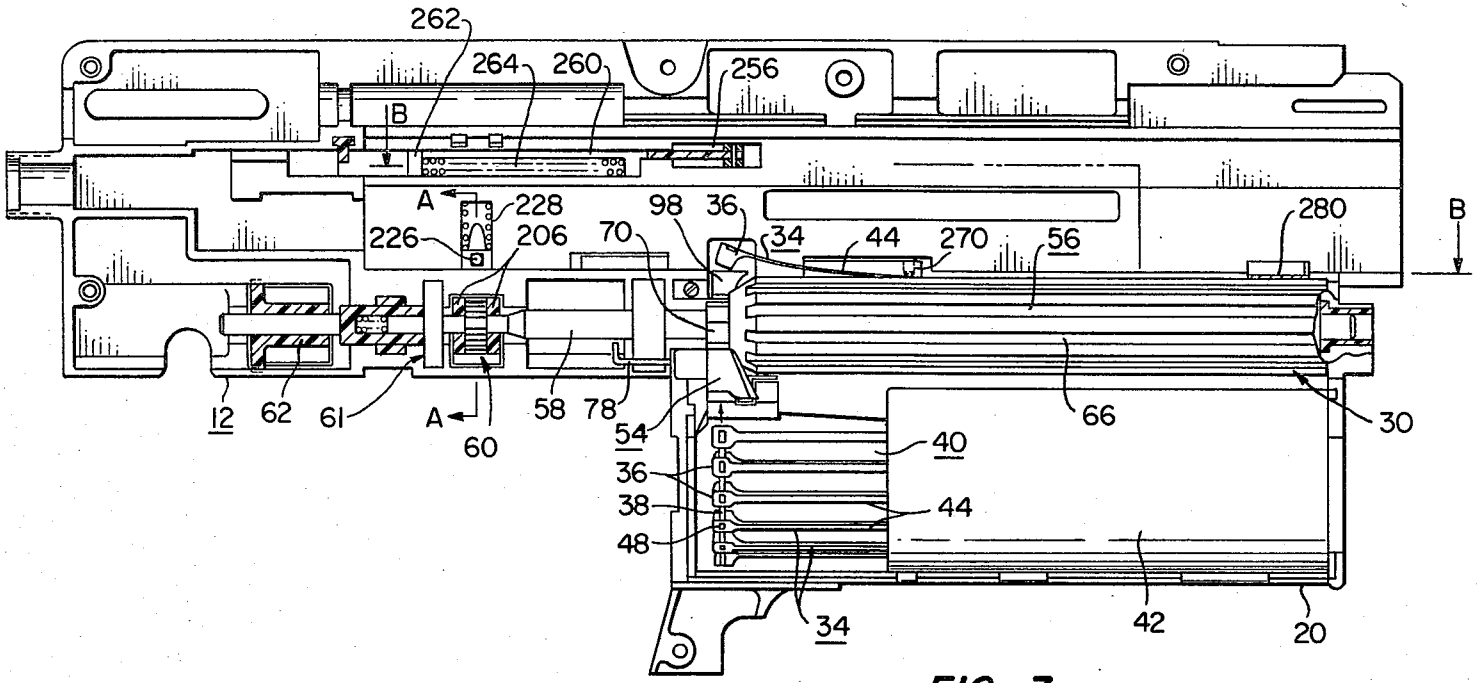
FIG. 3 is a side elevational view of the tool of FIG. 1 with the right side of the tool housing removed to expose internal tool mechanisms supported on the housing left side.
Figure 15:
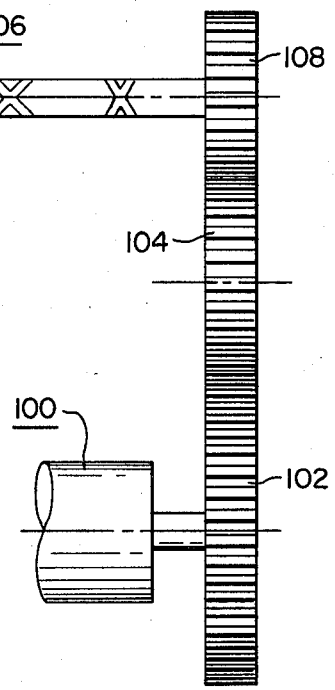
Figure 15:
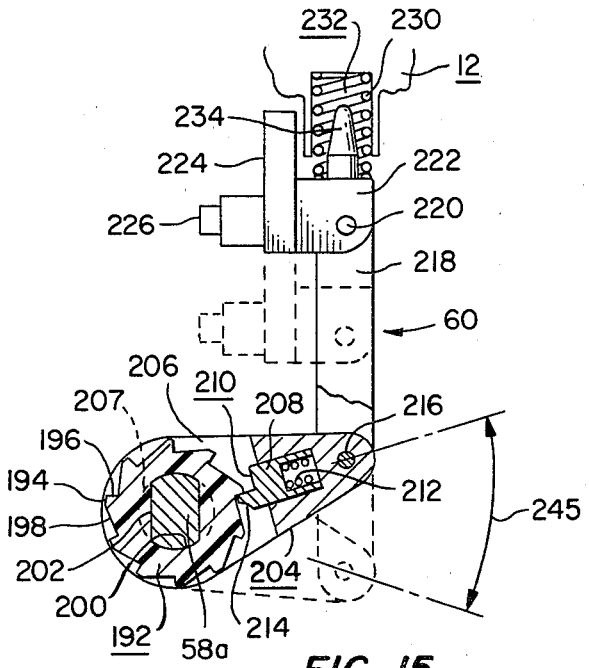

FIG. 15 is a cross-sectional view of the tie carrier indexing mechanism as viewed along lines A—A in FIG. 3.

Figure 16:
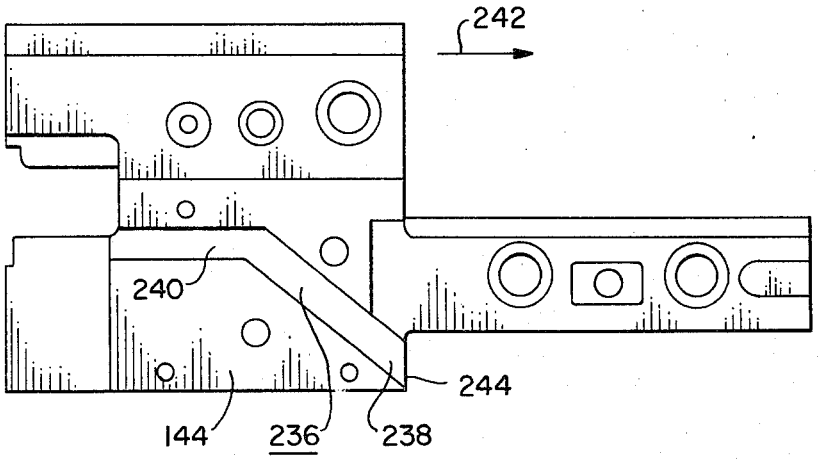

FIG. 16 is a side elevational view of the tensioning block member of FIG. 11 showing cam surfaces for engaging the indexing mechanism.

Figure 17:
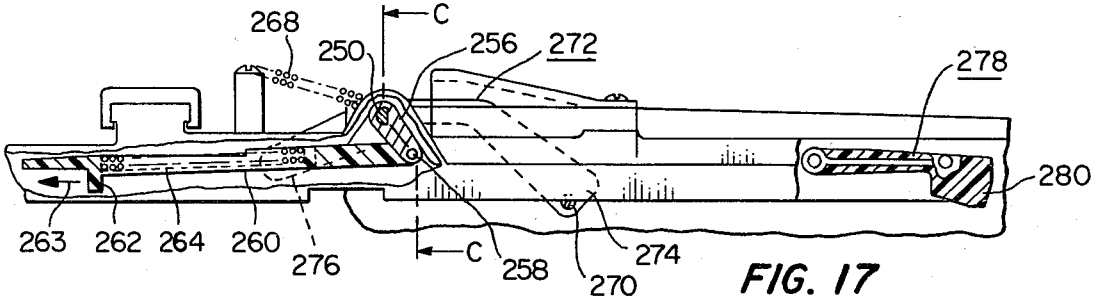

FIG. 17 is a fragmentary, partly sectioned plan view of the left side of the tool housing as viewed along lines B—B in FIG. 3.

Figure 18:
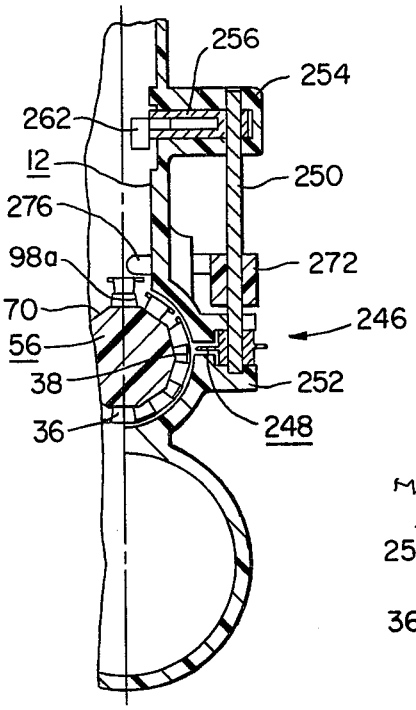

FIG. 18 is a fragmentary, front sectional view of the view of FIG. 17 as viewed along lines C—C to show the web cutting mechanism.

Figure 19:
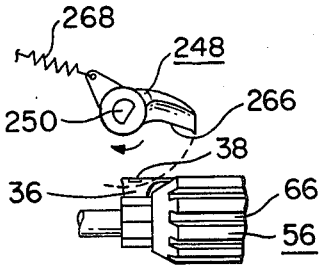

FIG. 19 is a fragmentary diagrammatic plan view of the web cutting mechanism.

Figure 20B:
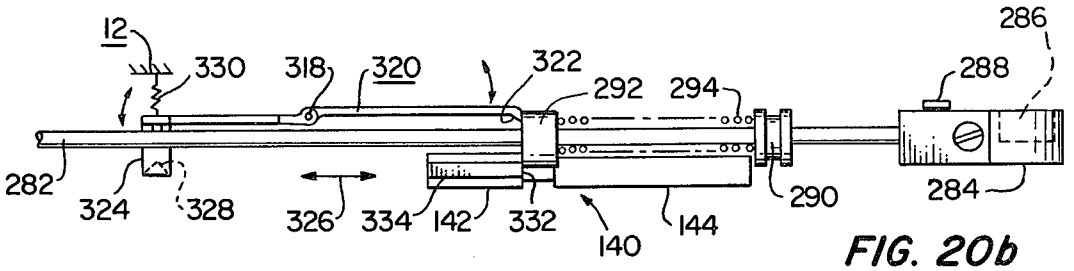
Figure 20A:
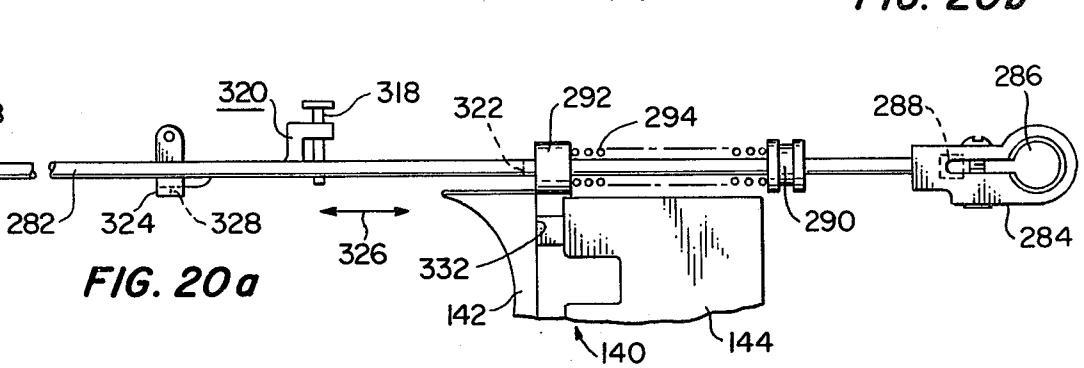

FIG. 20*a* is a side diagrammatic illustration of the upper hook mechanism showing the features of the mechanism with the hook in its open position.

FIG. 20*b* is a partial plan view of FIG. 20*a*.

Figure 20C:
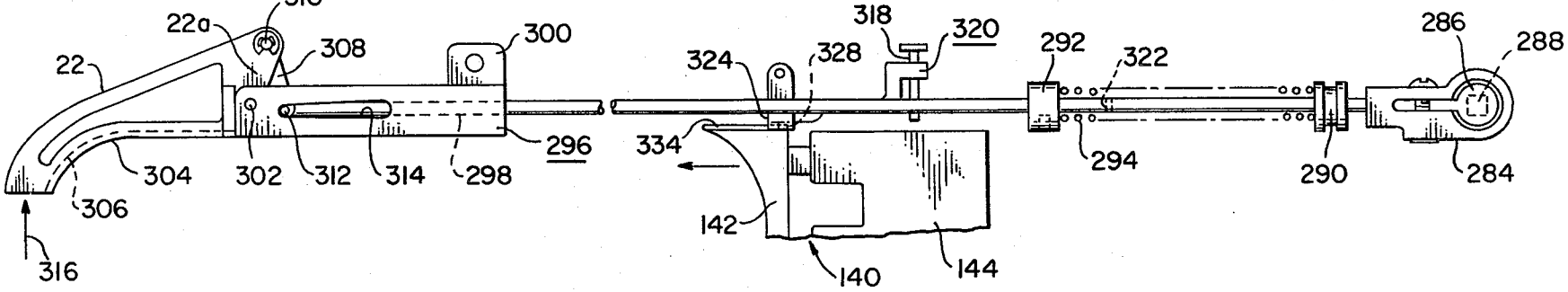

FIG. 20*c* is a side diagrammatic view of the upper hook mechanism shown in its closed position.

Figure 21:
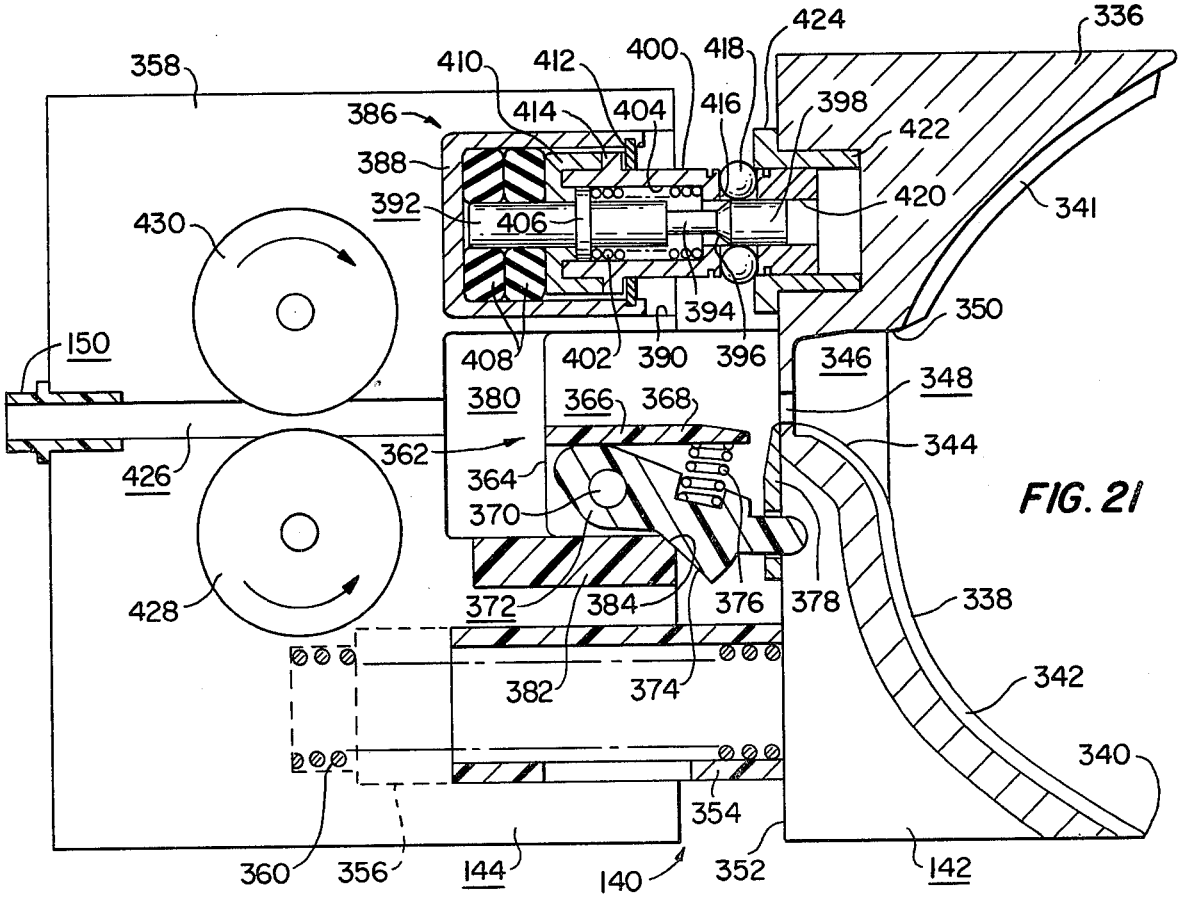

FIG. 21 is an enlarged, side elevational, partially sectioned view of the tie feeding mechanism of FIG. 12.

Figure 22:
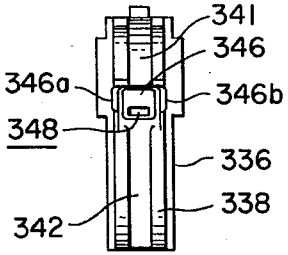

FIG. 22 is a front elevational view of the threading block member of FIG. 21 in reduced scale.

Figure 23:
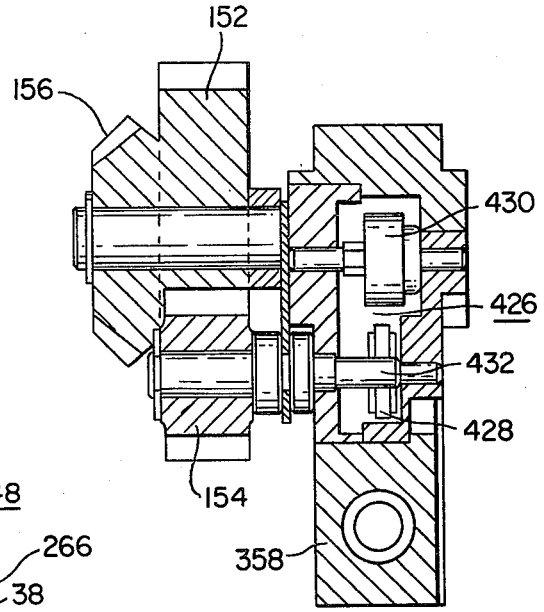

FIG. 23 is a front, partially sectioned view of the tensioning unit as viewed along lines D—D of FIG. 12.

Figure 24A:
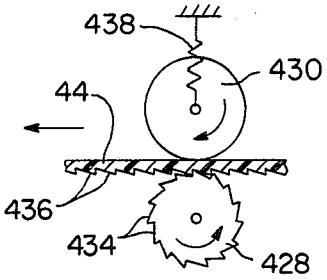
Figure 24B:
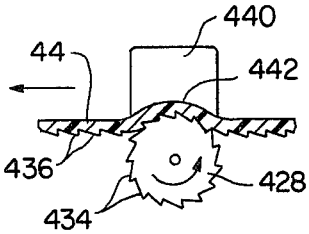

FIGS. 24*a* and 24*b* are side diagrammatic views of tie tensioning means in alternative arrangements.

FIGS. 25*a* through 25*e* are diagrammatic views illustrating the sequences of a bundling tie being positioned around a bundle of wires, tensioned and severed in accordance with the invention.

Figure 26:
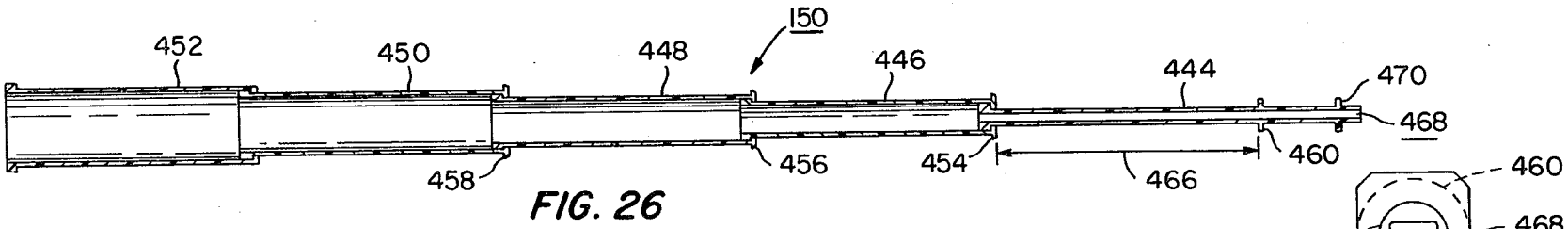

FIG. 26 is a side sectional view of a tie scrap ejector mechanism as shown in the partial assembly of FIG. 11.

Figure 27:
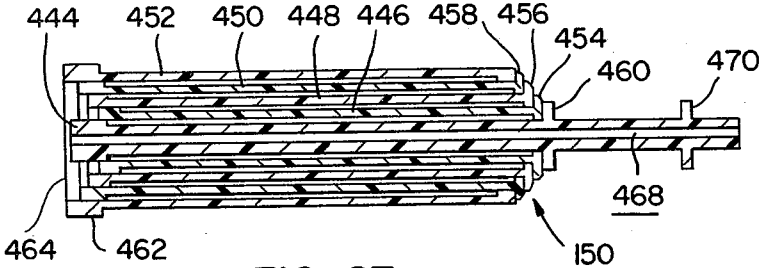

FIG. 27 is an enlarged, side sectional view of the ejector mechanism of FIG. 26 shown in a telescopically collapsed condition.

Figure 28:
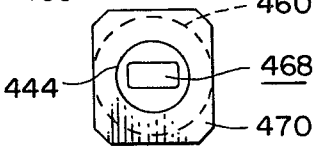

FIG. 28 is a front elevational view of the ejector mechanism of FIG. 26.

Figure 29:
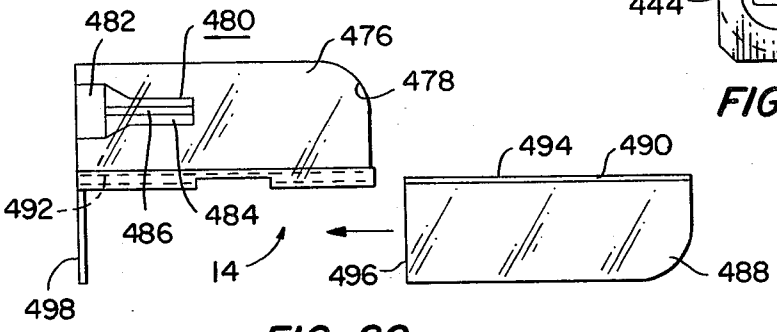

FIG. 29 is a side elevational exploded view showing the tie container assembly of FIG. 1 in a disassembled condition.

Figure 30:
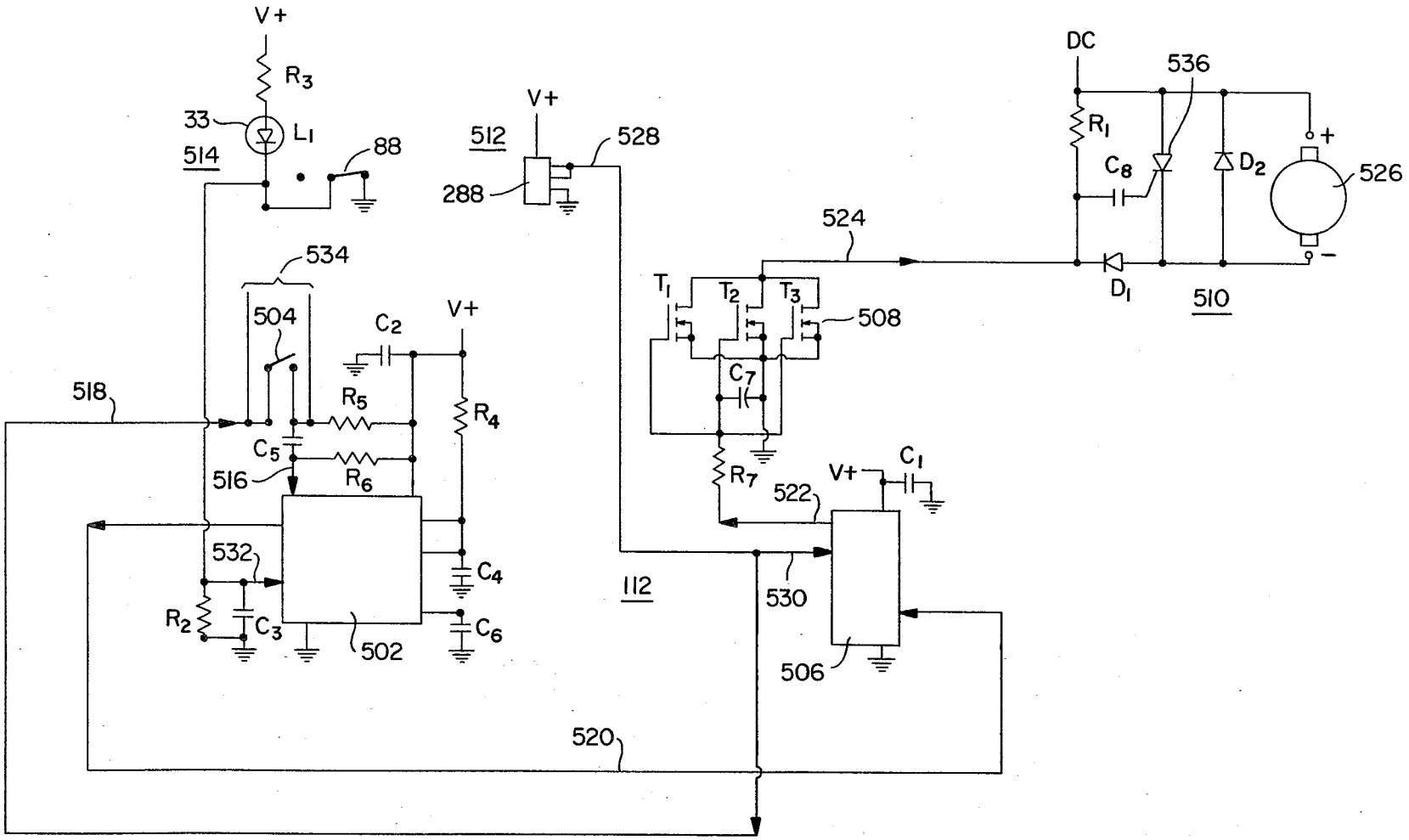

FIG. 30 is a schematic diagram of an electrical control system for the tool of the invention.

DESCRIPTION OF THE PREFERRED EMBODIMENTS

Figure 2:
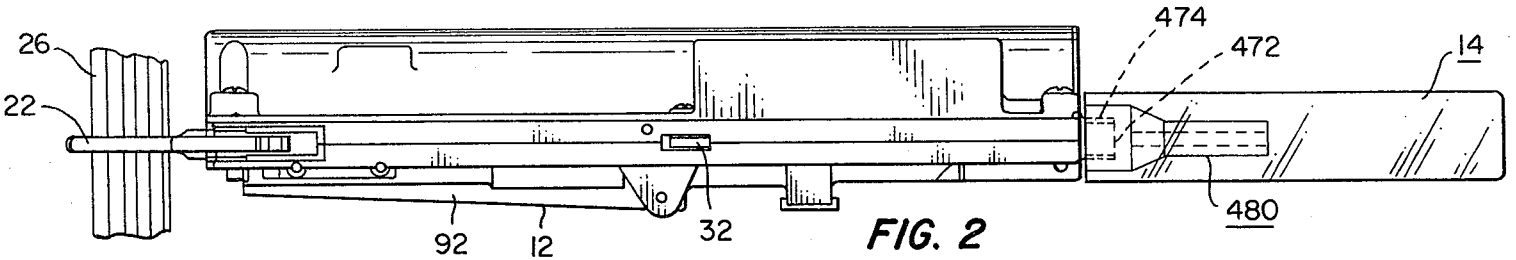
FIG. 2 is a top plan view of the tool of FIG. 1.

Referring to the drawing, there is shown in FIGS. 1 and 2 an automatic bundling tie applying tool, generally indicated as numeral 10, constructed in accordance with a preferred form of the invention. Tool 10 is shown in its assembled condition so that its overall external features may be appreciated. The tool 10 comprises a housing 12, preferably made of plastic, a scrap container assembly 14 suitably attached to the rearward housing end 15 and a handle 16 with a trigger 18 mounted therein. At the forward end 20 of the housing 12 where the ties are applied to a bundle of articles, there are a pair of hook members 22 and 24. The lower hook member 24 is stationary while the upper hook member 22 is movable with respect thereto. As depicted in FIG. 1, the hook members 22 and 24 are closed. This is the position the hooks will occupy during application of a bundling tie to a bundle of wires 26 already contained within the hooks 22 and 24. The movable upper hook 22 is movable to a position as shown in FIG. 20*a* for receipt of the wires 26 to be bundled therebetween. Once the wires 26 have been received within the confines of the hooks 22 and 24, the upper hook is closed to facilitate looping of a cable bundling tie about the wires 26. The hooks 22 and 24 are each provided with tracks adapted to receive and guide the bundling tie as it is moved about the closed hooks 22 and 24 and thus about the bundle of wires 26 placed therein. Means for introducing the bundling tie into the tool 10, and other means for positioning the tie at the hooks 22 and 24 and around the wires 26 will be described in greater detail hereinbelow.

As further shown in FIG. 1, extending from the bottom portion of the handle 16 is a suitable electric cord 28 for providing electric power to the tool 10. The cord 28 is connected to a suitable source (not shown) of electrical power. The source may be a power supply capable of converting conventional line 110 volt or 220 volt alternating current to direct current for operating an electric motor housed within the tool 10 as will be described. Alternatively, the source may be a battery supply capable of providing requisite direct current to the tool 10. Portability of the tool 10 may be achieved with the power converter or with the battery supply. The battery supply may be carried on the operator or built into the tool itself.

As shown in FIG. 1 the tool 10 includes a tie carrying mechanism 30 for supporting a plurality of ties thereon and subsequently advancing the ties to a position in preparation for looping as will be detailed. A ring 32 may be mounted atop the housing 22 as a means for balancing the tool 10 as well as for storing the tool 10 as by hanging. As will be described in greater detail, the tool 10 may be provided with a light indicator 33 for alerting the operator that the supply of bundling ties is depleted and needs replenishing.

Referring now to FIG. 3, the details of the tie carrying mechanism 30 and the tie loading features may be appreciated. FIG. 3 shows the tool 10 from the right hand side with a portion of the right side of housing 12 removed so as to reveal the inside of the left side of the housing and pertinent internal structure. In accordance with the preferred embodiment, the tool 10 is portable and designed to carry thereon a fixed amount of bundling ties 34, such as fifty ties or any other suitable quantity. The bundling ties 34 are of the self-locking type comprising an elongate, flexible strap portion 44 and a head portion 36 having a strap-receiving aperture 48 therethrough and may be of the type as shown and described by Noorily in U.S. Pat. No. 3,973,293, assigned to the same assignee as is the present invention. The tool 10 is adapted to receive individually a succession of ties 34 from a supply of ties that are interconnected between adjacent heads 36 by a thin, flexible web 38. The supply of interconnected ties 34 is held within a compartment 40 that is mounted on the housing 12 adjacent the tie carrying mechanism 30 for lateral transfer of the ties 34 thereto. A door 42 may be pivotably hinged to the bottom of the compartment 40 for opening to allow supplying the ties and for closing to hold the ties 34 within the compartment 40.

Figure 5:
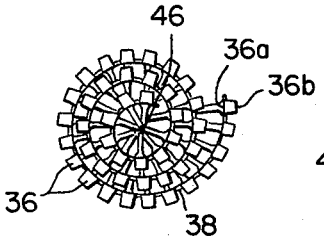
FIG. 5 is a front elevational view of the packaged ties of FIG. 4.
Figure 4:
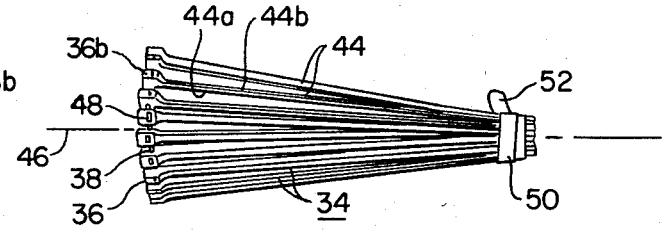
FIG. 4 is a side perspective view of a series of interconnected bundling ties packaged in accordance with one arrangement for use with the tool of the present invention.

As depicted in FIG. 3, the interconnected ties 34 are held within the compartment 40 preferably in a helically coiled arrangement wherein the heads 36 lie substantially in a common plane and the strap portions 44 of the ties lie substantially in a common direction longitudinally of the tool 10. The ties 34 are readily arranged in such a helically coiled arrangement prior to entry into the tool compartment 40 as shown in FIGS. 4 and 5. Typically, the ties 34 are fabricated in interconnected fashion using conventional molding techniques, the interconnected ties 34 extending in an array defining a flexible sheet of ties 34 wherein the heads 36 are in a substantially straight line and the strap portions 44 are spaced and substantially parallel at fabrication. Upon selection of a predetermined quantity of ties, such as, for example, fifty ties, the sheet of ties is rolled upon itself with suitable tooling to form the arrangement illustrated in FIGS. 4 and 5 wherein the interconnected ties 34 extend longitudinally along and in succession in a helical path about an axis 46.

The ties 34 employed for use in the tool 10 are of the type wherein the head 36 has a lower surface **36*a* and an upper surface 36*b*, the aperture 48 extending through each surface 36*a* and 36*b*. The lower surface 36*a* and a lower surface 44*a* of the strap 44 lie substantially in the same plane and the upper head surface 36*b* projects above the upper surface 44*b* of the strap 44 as shown in FIG. 4. These ties 34 are arranged in the preferred helically coiled configuration such that the upper head surface 36*b* of each tie 34 is radially more exterior than the lower head surface 36*a* as shown in FIG. 5. Such an arrangement provides for suitable transport in the tie carrying mechanism 30 and for proper positioning of the ties 34 for feeding to the application end 20** as will be described.

Upon arranging the ties 34 in the preferred helical configuration the ties 34 may be suitably packaged to maintain the arrangement for introduction into the tool 10. For example, as shown in FIG. 4, the free ends of the straps 44 may be bound as by a layer of tape 50 or any other suitable binder supported by the ties 34 for holding such ties 34 in the helical configuration. The packaged ties 34 held by binder 50 define a substantially frustro-conical shape wherein the heads 36 lie in a substantially common plane and collectively define the larger end of the cone. In the preferred package arrangement of the ties 34, the binder 50 is removable for temporarily holding the ties 34 together between fabrication and use. A tab 52 may be provided to facilitate removing the binder 50 from the ties 34. With reference now to FIG. 3, it is intended that a package of ties 34 be introduced into the open compartment 40, the lead tie inserted into a loading mechanism 54, the binder 50 removed and then the compartment door 42 closed for holding the ties therein. To facilitate loading of the ties 34 into the tool, the lead tie, i.e., the tie terminating the succession at the exterior of the helical arrangement, may be provided with indicia, such as colorcoded markings, symbols or shapes for ease of identification. It should be appreciated that other tie packaging arrangements may be utilized wherein the binder 50 may be removed after closing the compartment door 42 or the binder 50 may be retained on the ties 34 at all times while in the compartment 40.

Referring again to FIG. 3, the tie carrying mechanism 30 comprises a rotatable tie carrier 56, preferably in the form of a drum, the drum 56 being suitably mounted in the housing for rotation about its longitudinal axis. The drum 56 is rigidly secured to a drum shaft 58 that is in turn coupled to an indexing mechanism 60 for automatically, rotatably indexing the drum in predetermined arcs of revolution. An index centering mechanism 61 may also be coupled to the shaft 58 so as to minimize inertial override of the drum 56 during indexing and to provide precise positioning and retention of the drum upon indexing. A manual rotator 62 may be coupled to the drum shaft 58 so as to provide for manual rotation of the drum 56, if desired.

Figure 7:
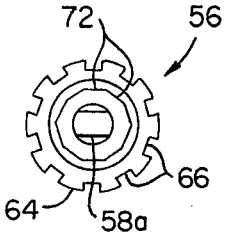
FIG. 7 is a rear elevational view of the tie carrier of FIG. 6.
Figure 6:
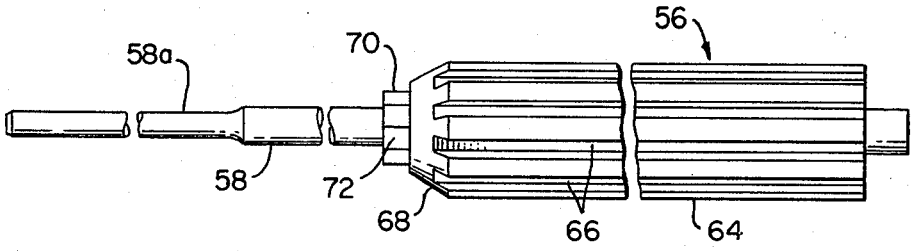
FIG. 6 is a side elevational view of a rotatable tie carrier depicted in FIG. 3.

As illustrated in FIGS. 6 and 7, the drum 56 comprises an elongate, generally cylindrical member 64 having a plurality of longitudinally extending grooves 66 spaced about the circumference of the member 64. In the preferred form, there are ten grooves 66 spaced substantially equally about the member 64, although any suitable number of grooves may be provided. The grooves 66 are formed to have a depth greater than the thickness of the strap portion 44 and a width slightly greater than the width of the strap portion 44 for accommodating and supporting the ties 34 therein, one tie 34 to a groove 66. At the end of the drum 56, adjacent the shaft 58, the member 64 preferably a tapered surface 68 tapering radially inwardly from the periphery of the member 64. Adjacent the tapered surface 68, the member 64 has a shoulder 70 having a diameter less than the outer periphery of the member 64. The shoulder 70 is preferably formed as a decahedron having ten substantially flat faces 72 therearound, each face 72 being aligned with one of the grooves 66. The drum 56, as described, is capable of supporting a series of interconnected ties 34 thereon wherein the strap portions 44 of the ties 34 are accommodated within the grooves 66 with the head portions 36 adjacent the flat faces 72 on the shoulder 70. The shaft 58 may be provided with one or more flat portions **58*a* for positive coupling to the indexing mechanism 60 (FIG. 3**).

As shown in FIG. 3, the tie loading mechanism 54 is mounted on the housing 12 adjacent the drum shoulder 70 and in communication with the tie holding compartment 40. The tie loading mechanism 54 is adapted to individually receive the interconnected ties 34 in succession from the feed of ties 34 held in the compartment 40 and to position the ties 34 individually in a groove 66. As depicted in greater detail in FIG. 8 and FIG. **8*a*, the loading mechanism 54 comprises a lower support 74 and an upper tie head guide 76 that together define a passageway 84 for entry and passage of a tie head 36 and, in communication with the passageway 84, a gap 79 of lesser dimension for passage of the adjacent strap portion 44 into the loading mechanism 54. The exit of the passageway 84 between the lower support 74 and the upper guide 76** is disposed to register with a flat face 72 on the drum shoulder 70 and the gap 79 with a groove 66 at each index position. Thus, as the tie head 36 emerges from the passageway, the strap portion 44 of the tie 34 is positioned in one of the grooves 66. The lower support 74 has an extent 81 that projects laterally beyond the exit and in covering relation to the groove 66 adjacent the shoulder 70 for holding the strap portion 44 in the groove 66. The extent 81 may be flexible for resiliently bearing against the drum 56 to hold the tie 34 in the groove 66 and to thereby provide a means for "snapping" the tie 34 in the loading mechanism 54.

In accordance with a preferred embodiment of the tie loading mechanism 54, the upper guide 76 is pivotally mounted as indicated by the arrow 77 in FIG. 8. A lever arm 78 is provided that is pivotable with the pivotal tie guide 76. As shown diagrammatically in FIG. 9, the lever arm 78 and thereby the tie guide 76 are biased as by a spring 80 such that in its normal biased position the guide 76 is pivoted about a pin 82 in a direction toward the lower support 74. Thus, in the normal position the passageway 84 between the lower support 74 and the tie guide 76 is preset to have a dimension less than the thickness of the tie head 36, i.e., the dimension between head surfaces 36*a* and 36*b*. As the tie heads 36 enter the constricted passageway 84 for positioning of the ties 34 in grooves 66, the tie guide 76 is pivotally displaced against the bias of the spring 80 and the lever arm 78 contacts an actuator 86 to actuate a sensing switch 88 suitably mounted on the tool housing 12. The pivotal upper guide 76 serves as a sensing element for sensing the presence and absence of a tie in the groove 66. The guide 76 is disposed such that sensing occurs in registry with the groove 66 at the "six o'clock" position, i.e., the groove within which ties are positioned by the tie loading mechanism 54. While actuated, the switch 88 provides a signal to the tool circuitry, as will be described, to permit operation of the tool. Once the last tie 34 in the series of ties leaves the loading mechanism 54, i.e., when the groove 66 at the "six o'clock" position in FIG. 9 is empty, the spring 80, in the absence of a tie in the groove 66, will pull the lever arm 78 away from the actuator 86, deactuating the switch 88. When the switch 88 is deactuated a signal is provided in the tool circuitry to interrupt and prevent further the operation of the tool 10. Also, when the switch 88 is deactuated a signal may be provided to actuate the light indicator 33 (FIG. 1) such that the operator would have a visual indication that the tool should be replenished with another supply of ties. With the groove 66 at loading mechanism 54 vacant, the lead tie 34 on another package of ties may be introduced as described hereinabove. It should be appreciated that with such a tool interrupting feature, none of the grooves 66 from the loading position to the feeding position need go empty, thereby reducing time between loading by eliminating unnecessary firing of "blanks". Such an interrupting apparatus is preferably accessible to an operator and may be manually manipulated to override the interlock feature if desired so as to operate an empty tool.

The ties 34 that are loaded and positioned in the grooves 66 on the drum 56 as shown in FIG. 3, are, upon indexing, collectively rotated around the drum 56 in substantially equal increments of thirty-six degrees. The grooves 66 hold each of the ties 34 respectively in an aligned position relative to the longitudinal axis of the drum 56 during rotation thereof. The inner surface of the wall portion 90 of the housing 12 adjacent the loading position of the heads 36 as shown in FIGS. 1 and 10, is formed to be closely spaced to the periphery of the drum 56 so as to permit drum rotation while holding the tie strap portion 44 in position for a comparatively short longitudinal extent 44*c* adjacent the tie heads 36. The housing 12 includes on its left side adjacent the drum 56, a curved wall portion 92, conforming in shape substantially to the curvature of the drum 56. An opening 94 is formed through the curved wall portion 92, the opening 94 communicating with a portion of the drum 56. An upper wall 96 of the opening 94 is formed to extend at an angle with respect to the longitudinal grooves 66 on the drum 56 inclining preferably from just above the axial center of the drum 56 at the forward end 20 down to near the bottom of the drum 56 at the housing portion 90. The inner edge of the upper wall 96 is also spaced closely to the outer periphery of the drum along the entire length of the wall 96.

As the drum 56 rotates, in a counter-clockwise direction as viewed from the hook end 20, the upper wall 96, in effect, defines an axially extending helical path along the adjacent portion of the drum 56. As the drum 56 is rotated and the ties are advanced from the loading position, the strap portions 44 are held in the grooves 66 initially only along the short longitudinal extent 44*c* as indicated hereinabove and shown in FIG. 10. Continued rotation of the drum 56 advances progressively a greater longitudinal extent of the strap portions 44 underneath the curved housing portion 92. During this continued rotation the upper wall 96 wipes the lengthwise remainder of the strap portions 44 into position along the drum 56 locating the ties into the grooves 66. Once beneath the curved portion 92, the closely spaced inner wall surface (not shown) holds the strap portions 44 in place. The advantage of such a holding and locating structure is shown by reference to FIG. 10. Due to manufacturing techniques, tie packaging and material properties, the interconnected ties 34 have a tendency to bow along their lengths and have varying degrees of separation at their free ends. By engaging and locating the strap portion 44 into the grooves progressively rather than all at once. greater tie distortions and variations can be tolerated thus minimizing tool jamming due to improperly located ties.

The interconnected ties 34 loaded and positioned in the grooves 66 at the "six o'clock" position are rotatably advanced around the drum 56 as the drum is incrementally indexed. At the "three o'clock" position as viewed from the hook end 20 of the tool, the ties are effectively located and held along their entire lengths within the grooves 66. At this "three o'clock" position, the web 38 between adjacent heads 36 is cut, as will be described. Continued rotation of the drum 56 advances separated ties 34 to the "twelve o'clock" position wherein an individual tie 34 is positioned as illustrated in FIG. 3 with its head lifted by a tie head lifter 98 for subsequent feeding to the hook end 20 of the tool 10 as will be described.

Turning now to FIG. 11, the details of the tool drive mechanism and tie feeding features are shown. A direct current motor 100 is suitably mounted in the tool housing 12 and drives a motor gear 102 positioned to engage an idler gear 104 suitably supported for rotation in the housing. A main rotatable drive shaft 106 is suitably supported in the housing 12 by ball bearings 107 and 109 respectively (FIG. 14*a*), the shaft extending longitudinally substantially along the length of the tool from the forward end 20 of the housing 12 to the rearward end 15. A gear 108 is suitably coupled to the rearward end of the drive shaft 106, gear 108 positioned to engage the idler wheel 104. It should be appreceiated that other suitable drive transfer means, such as, for example, belts or chains, may also be used to couple the drive shaft 106 to the motor 100.

The motor 100 is suitably connected as by connection means 110 to an electric circuit 112, preferably comprising a thin, flexible strip of electrical insulation with conductive elements therein and suitable electrical components attached thereto for providing an electrical system to control the tool operation as described more fully hereinbelow with reference to FIG. 30. The circuit 112 is suitably connected as by line 114 to the power source supplied to the tool through cord 28 (FIG. 1). The circuit 112 is suitably connected to the trigger 18 that, upon depression, actuates a switch 504 (FIG. 30) for energization of the motor 100. The sensing switch 88 described hereinabove with reference to FIG. 9 is also suitably connected to the circuit 112 for effectively interrupting tool operation when the switch 88 is deactuated.

At the forward end of the shaft 106, a gear 116 is coupled for rotation therewith and is positioned for engagement with a transfer gear 118 suitably mounted in the housing for rotation on a shaft 120. Mounted on the shaft 120 is a clutch mechanism 122 comprising a first clutch member 124 having a saw-toothed surface and a second clutch member 126 having a saw-toothed surface engageable with that of first clutch member for positive coupling thereto. The first clutch member 124 is suitably connected to the transfer gear 118 for rotation therewith. The second clutch member 126 is mounted on the shaft 120 and is maintained normally apart from the clutch member 124 by a compression spring 128. In their separated normal condition, as the transfer gear 118 and thereby the clutch member 124 rotate, the second clutch member 126 remains stationary. Suitably coupled to the second clutch member 126 for rotation therewith is a bevel gear 130.

The main drive shaft 106 has a double helical groove 132 comprising a left hand groove and a right hand groove extending axially along the shaft 106. A reciprocable carriage 134, the full details of which will be described, is movably coupled to the shaft 106. The carriage 134 includes means for engaging the helical groove 132 such that upon rotation of the shaft 106 the carriage 134 is driven linearly therealong. The pitch of each of the double helical grooves is preferably identical, each pitch varying at the shaft ends from the pitch at the center of the shaft 106 so as to vary the linear speed of the carriage 134 according to tool requirements. The right hand groove and left hand groove are arranged to terminate at a common location at the shaft ends as shown, for example, at groove termination 136, to provide for axial reversal of the carriage 134 thereat, thereby enabling continuous linear reciprocating movement of the carriage 134 as the shaft 106 rotates.

Suitably connected as by screws 138 to the carriage 134 for linear reciprocating movement therewith is a tie feeding mechanism, generally indicated as numeral 140. The tie feeding mechanism 140 comprises a tie threading unit 142 and a tie tensioning unit 144 which will be described more fully hereinbelow. The housing 12 is provided with upper and lower tracks 146 and 148, respectively, for guiding the feeding mechanism 140 in a precise linear path as it reciprocates within the tool 10. The path of the feeding mechanism extends coaxially with, but laterally displaced from, the axis of the shaft 106. A telescopic tie scrap ejector mechanism 150 is suitably connected to the feeding mechanism 140 for collapsible movement therewith, as will be detailed.

As shown in FIG. 12 in a view illustrating the tie feeding mechanism 140 from the side opposite that shown in FIG. 11, a pair of gears 152 and 154 are rotatably coupled to the tensioning unit 144 and positioned to engage each other. Connected to gear 152 for rotation therewith is a transfer bevel gear 156 engageable with the bevel gear 130 in the clutch mechanism 122. Gear 154 is suitably coupled to a rotary driving wheel within the tensioning unit 144, the details of which will be presented with reference to FIG. 21 and which, in brief, is employed to tension a tie 34 upon being looped around a bundle of articles. Attached to a portion of the tensioning unit 144 as by screw means 158 is a spring member 160 the function and purpose of which will be more fully understood with reference to FIGS **14*a* and 14*b*. As the shaft 106 rotates and linearly drives the carriage 134 and thereby the tie feeding mechanism 140 therealong, the transfer bevel gear 156 will engage the clutch bevel gear 130 as the feeding mechanism 140 nears the forward end 20. Continued motion of the feeding mechanism 140 in the forward direction will drive the normally stationary, separated clutch member 126 against the bias of the spring 128 and into positive coupling engagement with the clutch member 124 that is rotating with the drive shaft 106. Coupling of the clutch members 124 and 126 causes simultaneous rotation of the bevel gears 130 and 156 and gears 152 and 154 on the tensioning unit 144**.

The entire drive mechanism and gear train is illustrated in FIG. 13, wherein the clutch mechanism 122 is shown in the engaged position. Effective gear reduction is achieved for high rotational speed of the gear 154 that provides the drive for tie tensioning. For example, with the angular speed of the motor 100 at about 295 revolutions per minute, the gear 154 rotates at more than 3500 revolutions per minute. Such high gear speeds are desirable for rapid tensioning and severing of the tie positioned about the articles. With reference again the FIG. 11, movement of the carriage 134 and thereby the feeding mechanism 140 in a rearward direction disengages the bevel gears 130 and 156 thus removing the force overcoming the bias of spring 128 and decoupling the clutch mechanism 122. It should now be appreciated that the drive shaft 106 may be continuously rotated while the carriage 134 and the feeding mechanism 140 linearly reciprocate therealong, selectively coupling and decoupling the clutch mechanism 122 at the forward end of the stroke.

Referring now to FIG. **14*a* the details of the reciprocable carriage 134 are shown. The carriage 134 preferably includes a mechanism for interrupting for a period of time the movement of the carriage 134 and thereby the connected tie feeding mechanism 140 (not shown) while rotation of the shaft 106 continues. In FIG. 14*a* the carriage 134 is shown in a freely reciprocating position, while in FIG. 14*b* which will be described subsequently, the carriage 134 is in a locked position. Disposed adjacent the clutch mechanism 122 and in the path of the carriage 134 in its reciprocating stroke is a moveable detent 162 suitably mounted on the housing 12. The detent 162 is normally biased as by a spring 164 in a direction toward the shaft 106. The carriage 134, having the movement interrupting feature, comprises a sleeve 166 circumscribing the shaft 106. The sleeve 166 has an interior chamber 168 that confines therein a support ring 170 that supports a rudder 172 therein, the rudder 172 extending radially from the ring 170 into the helical groove 132 and being moveable with respect to the ring 170 for tracking the varying pitch and changing direction of the groove 132. Also confined within the sleeve chamber 168 is an axially slidable bushing 174 and a compression spring 176, the spring normally resiliently biasing the bushing 174 axially against the support ring 170. A cam actuator 178 has an arm portion 180 that extends into the chamber 168 and resiliently contacts the ring 170 under the influence of a spring 182. The spring 182 in actuality is provided in the operating tool by the spring member 160 (FIG. 12) that is attached to the feeding mechanism 140. The cam actuator 178 has an inclined cam surface 184 and a depressed portion 186 that together with a wall portion 188 of an opening provided in the sleeve 166 define a recess capable of receiving the detent 162 therein. The sleeve 166 has a tapered surface 190** in a forwardly facing direction.

As the carriage 134 linearly approaches the forward end 20 of the tool in its forward stroke, as illustrated in FIG. 14*b*, a corner edge of the detent 162 strikes the tapered surface 190, urging the detent upwardly against the spring 164. The sleeve 166 will slide against the detent 162 until the recess coincides with the detent 162, at which point the detent 162 will be resiliently pressed therein under the influence of the spring 164. Forward movement of the sleeve 166 and thereby the carriage 134 is prevented by the contact of the sleeve wall portion 188 of the recess with the detent 162. The interruption of the movement of the carriage 134 coincides in the preferred embodiment with the coupling of the clutch mechanism 122 as set fourth hereinabove, such that as the carriage 134 and thereby the feeding mechanism are stopped, the gear 154 for tensioning ties is rotating.

It should be understood that as the carriage 134 is effectively locked in the holding position, the drive shaft 106 is continuously rotating. With such rotation and while the sleeve 166 is stopped, the support ring 170 supporting the rudder 172 continues to move in a forward direction as depicted in FIG. 14*b*. Forward movement of the ring 170 causes the bushing 174 to axially slide forward relative to the stopped sleeve 166 compressing the spring 176 as the bushing 174 moves. When the rudder 172 reaches the groove termination 136 it engages the oppositely extending helical groove under the influence of the compressed spring 176, thereby causing reversal of the linear movement of the ring 170. The ring 170, having reversed direction, starts to move rearwardly within the chamber 168 and continues to move while the sleeve 166 remains locked until the ring 170 strikes the arm portion 180 of the cam actuator 178. At this point, the axial force from the movement of the ring 170 is transmitted to the inclined cam surface 184 which urges the detent 162 out from the recess, thereby releasing the carriage 134 for linear movement in the rearward direction and decoupling of the clutch mechanism 122. The time period of interrupted movement of the carriage 134 and thereby the feeding mechanism 140 is sufficient to permit tensioning and severing of a tie 34 positioned about a bundle of wires. At the rearward end of the shaft 106 as shown in FIG. 14*a*, a compression spring 191 is provided to resiliently engage the cam actuator 178 and to thereby cause the rudder 172 to change grooves and thus reverse the direction of the carriage 134.

Referring now to FIG. 15 and FIG. 3 the details of the indexing mechanism 60 for incrementally rotating the drum 56 are shown. The mechanism 60 includes a ratchet wheel 192 having a plurality of teeth 194, preferably ten, each tooth 194 having a substantially flat radially extending surface 196 and a sloping surface 198. The ratchel wheel 192 has an opening 200 preferably having a pair of flat portions 202 for receiving therethrough and positively engaging the flat portion 58*a* of the drum shaft 58 such that the ratchet wheel 192 and shaft 58 move together. A lower link 204 has a pair of legs 206 extending adjacent to and on either side of the ratchet wheel 192. Each leg 206 has an opening 207 for passage therethrough and clearance around the drum shaft portion 58*a*. The link 204 includes a cavity 208 therein for housing a pawl 210 and a compression spring 212. The pawl 210 includes a protruding portion 214 for engaging a flat surface 196 of a ratchet wheel tooth 194.

Pivotally connected to lower link 204 as at a pin 216 is an upper link 218. The upper link is connected as by a pin 220 to a bracket 222 onto which is mounted a guide plate 224. A cam follower 226, preferably circular, is mounted on the guide plate 224. The guide plate 224 is adapted to slidably fit into a slot 228 provided in a wall of the housing 12 as shown in FIG. 3, the slot 228 permitting vertical movement of the plate 224 and thereby the cam follower 226. A compression spring 230 is provided in an opening 232 in the housing 12 to normally bias the bracket 222 in the downward position. A post 234 may be provided to retain the spring 230 in position.

The cam follower 226 is disposed to extend laterally into the longitudinal stroke path of the tie feeding mechanism 140 and is adapted to engage a cam surface thereon. In FIG. 16, there is shown the surface of the tensioning unit 144 that is illustrated in FIG. 11 and that is in facing disposition to the cam follower 126. The tensioning unit 144 includes a cam surface 236 having an inclined portion 238 and a level portion 240. The cam surface 236 comprises a slot having a width and depth adapted to receive therein and guide the circular cam follower 226. In operation, as the feeding mechanism 140, as moved by the carriage 134, is in its rearward stroke as indicated by the arrow 242 in FIG. 16, the cam surface 236, upon reaching the location of the indexing mechanism 60, engages at its entrance 244 the cam follower 226. At this position, the cam follower 226 is at the lowest point of its vertical stroke as shown by the phantom lines in FIG. 15. Upon continued rearward movement of the tensioning unit 144, the cam follower 226 is guided up the inclined surface portion 238 until it reaches the level surface portion 240, whereat the cam follower 226 is at its highest point in FIG. 15. During the vertical movement of the cam follower 226 from its lowest to its highest point, the upper link 218 moves vertically upwardly simultaneously therewith, pulling the lower link 204 by pin 216 through an arc of revolution 245 about the axis of the drum shaft 58. As the lower link 204 moves through the arc of revolution 245, the pawl 210, engaging the flat portion 196 of the tooth 194, pulls the ratchet wheel 192 through the same arc of revolution 245. The ratchet wheel being positively coupled to the shaft 58, in turn rotates the shaft 58 and thereby the drum 56 through the arc of revolution 245. The indexing linkage and path length of the cam surface 236 are dimensioned such that the arc of revolution 245 is thirty-six degrees in the preferred embodiment, although other desirable increments may also be used. In the forward stroke of the tensioning unit 144, the cam follower 226 is guided by the cam surface 236 back to its vertically lowest point and then held thereat by the influence of the spring 230. During movement of the cam follower 226 to the lowest point, the protruding portion 214 of the pawl 210 slides along the sloping surface 198 of the succeeding tooth 194 in a clockwise direction against the bias of the spring 212. When the pawl 210 passes the peak of such succeeding tooth 194 the protruding portion 214 under the bias of the spring 212 engages the flat surface 196, preventing reverse movement of the ratchet wheel 192 and holding the wheel 192 in position for further indexing of the drum 56.

Referring now to FIGS. 3, 17 and 18, the details of a mechanism for cutting the web 38 between interconnected ties 34 may be appreciated. As shown in FIG. 18, a web cutting mechanism 246 is suitably disposed in the preferred embodiment to cut the tie web 38 at the "three o'clock" position, looking at the tool from its forward end 20. The cutting mechanism 246 comprises a knife 248 pivotally attached for lateral movement with respect to the drum 56 about a rod 250. The knife 248 is disposed adjacent the drum 56 and, in its normal stationary position, provides for clear movement of the tie heads 36. The rod 250 is suitably mounted for rotation at its lower end by an aperatured pedestal 252 for receiving and supporting the rod 250 therein and at its upper end by an apertured support 254. The pedestal 252 and the support 254 are suitably secured to the housing 12, preferably on its exterior surface.

Suitably connected to the upper end of the rod 250 for rotation therewith is a link 256. The link 256 extends supportively within the support 254 laterally with respect to the length of the tool and into the interior of the housing 12. At its interiorly extending end, the link 256 is pivotally connected, as by a pin 258, to one end of a slidable bar 260 extending lengthwise along the housing 12 and suitably supported for longitudinal sliding movement thereon. Attached to the bar 260 at its other end is an actuating lever 262. The lever 262 is disposed within the interior of the housing 12 and in the stroke path of the feeding mechanism 140 longitudinally reciprocating therein. Upon the rearward movement of the feeding mechanism, the actuating lever 262 is adapted to be struck by the tensioning unit 144 and to thereby move the bar in a rearward direction as indicated by the arrow 263. A spring 264 is utilized to return the bar 260 and thereby the lever 262 to its original position as the feeding mechanism 140 moves in the forward direction.

In operation, as the bar 260 is drawn rearwardly, it pivotally rotates the link 256 which, in turn, rotates the rod 250 and thereby the knife 248. As illustrated diagrammatically in FIG. 19, the knife 248 has a sharp blade 266 that has sufficient radial extent from the rod 250 for extending, during rotation, laterally interiorly of the tool housing 12 beyond the position defined by the interconnecting tie webs 38. Thus, as the knife 248 is rotated, it cuts the web 38, thereby separating adjacent tie heads 36 and providing individual ties. A spring 268 may be used to assist the knife 248 to return to its original position as the lever 262 is released by the forwardly moving feeding mechanism 140. It should be noted that the web cutting operation occurs at a time in the tool operation when the drum 56 and thereby the series of ties in the grooves 66 thereon are stationary, the drum 56 having been indexed and the ties suitably positioned for separation just prior thereto by the rearward motion of the feeding mechanism 140.

It can now be appreciated by further references to FIG. 18, that continued indexing of the drum 56 advances the separated, individual ties 34 to the tie feeding position which in the preferred embodiment is at "twelve o'clock". At the feeding position, a tie head 36 is suitably lifted by an inclined surface **98*a* of the tie lifter 98 disposed closely adjacent the drum shoulder 70 for lifting the tie head to a position as shown in FIG. 3. At this position with the tie head 36 lifted, the tie strap 44 is held within the groove 66 by a spring loaded tie holder 270 suitably attached to a pivotal rocker member 272 as shown in FIGS. 3 and 17. The rocker member 272 is suitably supported in the housing 12 and is freely pivotal about the rod 250. The member 272 has a front arm 274 and a back arm 276 that each have extent for laterally extending into the stroke path of the reciprocable feeding mechanism 140. The construction of the rocker member 262 is such, however, that when the front arm 274 is in the stroke path the back arm 276 is clear of the stroke path and vice-versa, the function of which will be described hereinbelow. The holder 270 is arranged on the front arm 274 to extend over the groove 66 as the front arm 274 extends into the stroke path. The holder 270 has means, such as a ball or plunger (not shown) for extending radially within the groove 66 of the drum 56 so as to provide a resilient contact with the strap portion 44 to hold it in position in the groove 66. An additional tie retainer 278 may be provided to hold the extreme tail portion of the strap 44 in the groove 66 at the forward end 20, the retainer 278 being fixedly supported by the housing 12 and having a lateral extent 280 extending over the groove 66** at the feeding position.

Turning now to FIGS. 11 and **20*a*, the details of the mechanism for effecting movement of the upper hook 22 are shown. The mechanism comprises an elongate, preferably circular, rod 282 having affixed at one end a magnet support member 284 suitably housing therein a magnet 286. The magnet support member 284 is made of non-magnetic material and is preferably a non-metallic material, such as plastic. The magnet 286 is adapted to actuate a magnetic switch 288, such as a Hall-effect switch, suitably mounted on the tool housing 12 near its rearward end 15. The switch 288 is suitably connected to the circuit 112 and, when actuated as will be described, provides a signal to the circuit 112 for controlling the operating cycle of the tool 10. In FIG. 20*a*, the magnet 286 is in a first position distant the switch 288 whereby the switch 288** is in the "off" condition.

Adjacent the magnet support 284 and axially interior thereof is a bushing 290 on the rod 282 and freely moveable therealong. The bushing 290 in assembly is securely fixed to the housing 12 such that it remains in a fixed disposition, the rod 282 being axially displaceable therethrough. Axially more interior than the bushing 290 and spaced therefrom is a ring collar 292 suitably affixed to the rod 282 for movement therewith. A compression spring 294, in a compressed state, is captured between the bushing 290 and the collar 292. The spring 294 normally biases the upper hook 22 toward its closed position, as will be described.

At the opposite end of the rod 282, there is provided a hook supporting member 296 having an aperture 298 for axially, slidably receiving the rod 282 therein. The hook supporting member 296 is fixedly secured to the forward end 20 of the housing 12 as at flange 300. The upper hook 22 is pivotally attached to the supporting member 296 as by a pin 302 for pivotal movement thereabout. The hook 22 has, as does hook 24, an arcuate section 304 with a track 306 extending interiorly of and therealong for guiding the strap portion 44 of the bundling tie 34 therein to position the tie 34 around a plurality of wires or the like. At the back end 22*a* of the hook 22 at a point spaced from the pin 302, one end of a link 308 is pivotally coupled to the hook 22 by a pin 310. The other end of the link 308 is pivotally coupled by a pin 312 to the rod 282. The pin 312 is supported for slidable rectilinear movement in the axial direction of the rod 282 by a slot 314 provided in the hook supporting member 296. The slot 314 is preferably formed to be tapered in a direction toward the hook 22, the opening of the slot 314 at its narrower portion being closely dimensioned to the size of the pin 312. Such a tapered slot 314 is provided to compensate for various tolerance deviations in the mechanism to thereby retain the hook 22 in its closed position (FIG. 20*c*) in a precise location contacting the lower hook 24 (not shown), minimizing excessive free play and gaps between the hooks produced as a result of "bouncing" during closing of the upper hook 22.

The back portion 22*a* of the hook 22 and the pinned link 308 define a toggle linkage with the toggle joint at pin 310. The back hook portion 22*a* represents a first bar of the linkage and the link 308 the second bar. The toggle joint at the pin 310 is freely floating while the ends of the respective linkage bars are coupled as at pin 302 and 312, respectively. The pin 302 is fixed on the supporting member 296 while the pin 312 is slidably movable in the slot 314. As the back hook portion 22*a* constitutes one of the toggle linkage bars, movement of the portion 22*a* in the toggle linkage moves the entire hook 22. It should be appreciated that a separate linkage bar 22*a* may be used, with the hook 22 suitably affixed thereto for movement therewith. The linkage is so constructed that as the pin 312 is in the rearward portion of the slot 314, the hook 22 is in the open position as shown in FIG. 20*a*. With the pin 312 in the forward preferably constricted portion of the slot 314, the hook 22 is in the closed position as shown in FIG. 20*c*, whereby with the fixed lower hook 24 (not shown) a completed loop is formed for positioning bundling ties around articles.

In the closed hook position, the linkage is dimensionally formed such that the toggle joint at pin 310 is nearly vertically centered over the pin 312, i.e., the toggle link 308 is substantially perpendicular to the direction of the sliding movement of the pin 312. It should be appreciated that if a force were applied to the hook 22 in a direction as shown by the arrow 316, only a negligible amount of such force would be transmitted to the toggle joint 310 in the horizontal direction and likewise to the pin 312. In the absence of a sufficient horizontal force applied to the pin 312 to overcome the frictional force thereat, the pin 312 will remain stationary and the hook 22 will remain closed in a locked position due to the construction of the toggle linkage. Such a feature is desirable in preventing either intentional or accidental opening of the upper hook 22, in particular, during tool operation. Moreover, with the tapered slot 314 having a close fit to the pin 312 for precise positioning of the hook 22, additional friction may be provided to further prevent complete opening of the hook 22 from its closed or slightly open position.

The operation of the hook may now be understood by reference to FIGS. 20*a*, 20*b*, 20*c* and FIG. 11. With the hook supporting member 296 and the bushing 290 securely attached to the housing 12, the rod 282 is longitudinally slidable in the tool. The hook assembly is mounted in the housing 12 such that a portion of the ring collar 292, moveable with the rod 282, extends into the stroke path of the feeding mechanism 140. Pivotally mounted on the housing 12 as by a pin 318 is a locking arm 320, disposed longitudinally adjacent the rod 282 and laterally displaced from the feeding mechanism stroke path. At one end of the locking arm 320 is a latch 322 adapted to engage a surface portion of the ring collar 292. At the other end of the locking arm 320 a hook actuating lever 324 is provided. The actuating lever 324 has an extent that extends laterally into the stroke path 326 of the feeding mechanism 140. The lever 324 has at its distal cantilevered end a tapered cam surface 328 adapted to engage a top portion of the threading unit 142 during forward movement thereof. A spring 330 is provided to bias the locking arm 320 such that the latch 322 in its normal position extends into the lengthwise path of the ring collar 292 as it moves with the rod 282.

In FIGS. 20*a* and 20*b* the hook 22 is shown in the open position and is locked therein by the locking arm 320. Such positioning and locking is effected as follows. As the feeding mechanism 140 is in its rearward stroke, a trailing surface 332 of the threading unit 142 engages the ring collar 292, driving the collar 292 rearwardly against the spring 294 that normally urges the hook 22 closed and thereby moving the rod 282 therewith. Rearward movement of the rod 282 simultaneously moves the pin 312 in the slot 314 to open the hook 22. During its movement, the collar 292 is driven axially rearwardly to the axial position of the latch 322 whereat it pushes the latch 322 laterally away, the latch 322 sliding along the collar 292 as it moves rearwardly thereby. As the collar 292 axially passes the latch 322, the latch 322, under the influence of the bias spring 330, springs back into the lengthwise path of the collar 292 for engaging the forwardly facing surface of the collar 292. Thus, further forward movement of the collar 292 and thereby the rod 282 is prevented, effectively locking the hook 22 in its open position. Rearward movement of the rod 282 also moves the magnet 286 away from the switch 288 thereby deactuating the switch 288, which thus provides a signal to the circuit 112 to terminate the operation of the tool 10. At the termination of the tool operation, the feeding mechanism 140, as driven on the rotary shaft 106 by the carriage 134, has reached the point on the shaft 106 whereby it is positioned in the helical groove 132 to reverse direction, i.e., move forwardly, in further operation.

Unlocking and closing of the hook 22 is effected as follows. A signal from the tool trigger 18 energizes the motor 100, causing the feeding mechanism 140 to move forwardly as shown in FIG. 20*c*. As the feeding mechanism 140 moves toward the lever 324, the collar 292 is held in the fixed position by the latch 322. As the threading unit 142 reaches the lever 324, the forward edge of a side surface 334 thereon engages the tapered cam surface 328. As the side surface 334 continues to engage the tapered surface 328, the lever 324 is pulled against the bias of the spring 330, and as shown in FIG. 20*b*, the locking arm 320 is pivoted about the pin 318 thereby moving the latch 322 laterally away from the collar 292. Upon movement of the latch 322 away from the collar 292, the hold on the collar 292 is removed and, under the influence of the compressed spring 294, the collar 292 is urged forwardly, thereby simultaneously moving the rod 282 and the pin 312 forwardly and closing the hook 22. As the rod 282 moves forwardly, the magnet 286 is also moved from its first position distant the switch 288 to a second position immediately adjacent the switch 288. At such second position the switch 288 is actuated thereby providing a signal to the circuit to override the signal from the trigger 18 for control of the tool operation until the switch is deactuated by movement back to its first position as described hereinabove.

Turning now to FIG. 21, the details of the tie feeding mechanism 140 are shown. As described herein, the tie feeding mechanism is operative due to its reciprocating longitudinal movement within the tool to index the rotary drum 56, actuate the web cutting mechanism 246 and open, close and lock the upper hook 22. As now to be described, the tie feeding mechanism 140 is also operative to feed a tie 34 to the hooks 22 and 24 and thereat loop the tie 34 around a wire bundle, tension the looped tie and then at a preselected tie tension sever the excess portion of the tie strap 44. The tie threading unit 142 comprises a block member 336 having a curved, forwardly facing surface 338 the bottom edge 340 of which is relatively sharp to facilitate engaging and picking-up the tie head 36 as the tie 34 is in its feeding position as described and shown with reference to FIG. 3. A slot 342 is formed in the lower portion of the curved surface 338, the slot 342 having depth and width to accommodate therein the strap portion 44 to be fed. A similar slot 341 is provided in the upper portion of the curved surface 338. About centrally located in the surface 338 and communicating with the slot 342 is a tie seat 344 comprising a recess 346 extending within the block member 336 and configured to closely conform to the external dimensions of tie head 36 to receive and support tie head 36 therein. An aperture 348, preferably rectangular in cross-section, extends through the block member 336 and communicates with the recess 346, the aperature 348 adapted to receive therethrough the strap portion 44 of a tie 34 upon emerging through the tie head 36 during threading. As shown in FIG. 22, the recess 346 may, in both lateral directions, have extended width portions as at **346*a* and 346*b* at a depth to accommodate portions of the web 38 remaining on either side of the tie head 36 after tie separation so as to assure proper seating of the head 36 in the seat 344**.

Referring back to FIG. 21, the upper portion of the curved surface 338 adjacent the tie head seat 344 has a forwardly projecting portion 350 serving as a mechanical stop for the tie head 36 as it slides along and up the lower surface 338, as will be described. On the member 336 near its bottom on the surface 352 opposite the curved surface 336 is a projecting guide member 354 adapted to be slidably received in an opening 356 in a block member 358 of the tensioning unit 144. A spring 360 may be included in the opening 356 to normally bias the threading block member 336 away from the tensioning block member 358.

Included on the threading block member 336 on its surface 352 and adjacent the aperture 348 is a tie strap severing mechanism 362. The severing mechanism 362 comprises a support member 364 onto which is fixedly mounted a plate 366 the upper surface 368 of which is disposed to lie preferably in a common plane with the lower surface of the rectangular aperture 348. Pivotally attached as by a pin 370 to the support member 364 beneath the plate 366 is a severing actuator 372, having a cam surface 374. Captured between the plate 366 and the actuator is a compression spring 376, normally biasing the actuator 372 downwardly away from the plate 366. Attached to the free end of the actuator 372 is a blade 378, adapted to move with the pivotal actuator 372 and to slide vertically along the surface 352 of the threading block member 336. In its normal position, the blade 378 is disposed adjacent to, but clear of, the aperture 348. The blade 378 is slidable across the aperature 348 during movement, such that with the rearward edges of the aperture 348 a shearing action is provided to sever a tie strap 44 extending through the aperture 348.

The tensioning block member 358 has a cavity 380 for receiving slidably therein the support member 364, the cavity 380 being formed for a close fit with the support member 364. At the lower portion of the cavity 380, a cam block 382 is provided for engaging the cam surface 374 on the actuator 372. During operation, as will be detailed, as the support member 364 slides within the cavity 380, the actuator cam surface 382 engages a block surface 384, causing the actuator 372 to pivot against the spring 376 and to thereby slidably move the blade 378 along the surface 352 across the aperture 348. Upon withdrawal of the support member 364 from the cavity 380, the spring 376 urges the actuator 372 pivotally away from the plate 366 and thereby returns the blade 378 to its normal position.

At the upper portion of the feeding mechanism 140 and supported between the threading block member 336 and the tensioning block member 358 is a tension sensing device 386. The tensioning device 386 provides means for preventing penetration of the support member 364 into the cavity 380 and actuation of the severing mechanism 362 until a predetermined force is applied to the threading block member 336 in a direction toward the tensioning block member 358. The force applied to the threading block member 336 is the tension developed in the tie strap in the tensioning unit 142, the tensile force being transmitted to the seat 344 through the tie head 36. As the tension produced in the strap and thereby transmitted to the block member 336 reaches a preselected level, the tension sensing device 386 will permit movement of the support member 364 into the cavity 380 for actuation of the tie severing mechanism 362.

The tension sensing device 386 comprises a cap 388 adapted to be inserted within an opening 390 in the tensioning block member 358. Housed within the cap 388 is an elongate stem 392, preferably cylindrical, having a portion 394 of reduced diameter and a tapered surface 396 extending from the reduced portion to the outer periphery 398 of the stem 392. One end of the stem 392 is located closely to or in contact with the cap 388. Axially slidably movable on the stem 392 is an elongate, generally cylindrical, hollow compressing member 400. A spring 402 is suitably disposed in a precompressed condition within a chamber 404 interiorly of the compressing member 400. The spring 404 is captured between an interior wall of the chamber 404 and a flange 406 on the stem 392. A pair of compressible pads 408 such as, for example, rubber O-rings, are held within the cap 388, the pads 408 being contacted by a pressure distributor 410 which in turn contacts the compressing member 400. The pads 408 are compressed to a predetermined dimension by the distributor 410 and the pads 408 are held in such compressed condition by a retainer ring 412 rigidly supported by an interior slot in the cap 388 and engaging an outer shoulder portion 414 of the compressing member 400, firmly holding the distributor 410 against the pads 408. In such compressed state, the pads 408 serve as spring means with a known spring constant such that the force required to further compress the pads 408 a given distance can be readily predicted. It should be appreciated that one or more pads 408 may be used to provide a desired spring constant and that other suitable spring means may also be used.

The compressing member 400 includes an opening 416 for receiving therein sensor elements such as a plurality of balls 418. In the preferred embodiment, three balls 418 are located in the compressing member openings 416 and are spaced equally apart. The compressing member 400 has an inner diameter 420 communicating with the openings 416 and closely dimensioned to the outer stem periphery 398. The balls 418 are disposed within the openings 416 to rest upon the outer stem periphery 398 in the normal condition of the tension sensing device 386. On the stem periphery 398, the balls 418 are located a small axial distance, on the order of mils, from the tapered surface 396. The balls 418 are chosen to have a diameter greater than the wall thickness of the compressing member 400 such that when in the holes 416 and on the stem periphery 398, a portion of the balls 418 project exteriorily beyond the outer periphery of the compressing member 400. With the center of the balls 418 disposed between the outer and inner diameters of the compressing member 400, the balls may be retained within the openings 416 as by peening the compressing member 400 closely adjacent the openings 416. A bushing 422 is provided in the threading block member 336 to slidably receive therein and support the compressing member 400. The bushing 422 has a flange portion 424 adapted to contact the exteriorly extending portions of the balls 418.

The tension sensing device 386 operates as follows. As a force is applied to the threading block member 336 during tie tensioning, the block member 336 is urged toward the threading block member 358 until the bushing flange 424 engages the balls 418 which serve as a detent until the predetermined tension is reached. The force applied to the balls 418 is transmitted through the compressing member 400 to the distributor 410 and ultimately to the pads 408. When the applied force is sufficient to compress the pads 408 in measure corresponding to such small axial distance the balls 418 are axially situated from the tapered surface 396, the balls 418 will be displaced to the tapered surface 396. The stem 392 is held from axial movement by contact with the cap 388. At the tapered surface 396, the balls 418 move radially inwardly therealong to the reduced diameter stem portion 394. During this radial inward movement, the exteriorly projecting portions of the balls 418 are displaced to a position within the inner diameter of the flange 424 effectively removing the detent against the bushing flange 424. the bushing 422 is thus allowed to readily, slidably move passed the balls 418 and along the compressing member 400, thereby permitting movement of the block member 336, penetration of the support member 364 into the cavity 380 and actuation of the severing mechanism 362. Upon severing of the tie strap 44 the tensile force on the block member 336 is thereby removed and the block member 336 and the balls 418 are returned to their normal position by the spring 404. The lower spring 360 provides a force balancer in returning the block member 336 to its normal position so as to prevent jamming or cocking during return movement. As described herein, the utilization of the tension developed in the tie strap during tensioning to apply a force to the block member 336, moveable with respect to the block member 358 and the means for effecting severance of the tie strap at a predetermined tension are substantially as set forth in copending reissue patent application of U.S. Pat. No. 4,064,918, the reissue application being filed Dec. 4, 1979 and assigned to the same assignee as is the subject invention.

As shown with further reference to FIG. 21, the tensioning block member 358 has an opening 426 communicating with the cavity 380 for receiving a tie strap 44 portion therein. The scrap ejector mechanism 150, as shown in FIG. 11, is suitably connected to the block member 358 to communicate with the opening 426 for receipt and ejection of excess severed strap portions, as will be described. Disposed adjacent the opening 426 and on either side thereof are a pair of wheels 428 and 430, respectively, suitably mounted for rotation on the block member 358. In the embodiment illustrated, the wheel 430 is an idler wheel and the wheel 428 is a driver. The wheels 428 and 430 are spaced apart a distance to receive compressively tangentially therebetween the tie strap portion 44. The wheels 428 and 430 are spaced lengthwise from the tie seat 344 a distance such that upon looping of the tie around a bundle of wires and threading through the tie head portion 36, the end of the tie is gripped by the wheels 428 and 430 for pulling action therebetween. As illustrated in FIG. 23, the driving wheel 428 is coupled as by a shaft 432 to the gear 154 mounted on the exterior of the tensioning unit 144 as shown in FIG. 12, gear 154 being driven by the gear 152. As indicated hereinabove, when the bevel gear 156, connected to the gear 152, engages the bevel gear 130 to actuate the clutch mechanism 122, gear 154 is driven, thereby driving the wheel 428.

As shown in FIG. 24*a*, the driving wheel 428 is formed preferably as a ratchet wheel having a plurality of teeth 434 thereon to mateably engage serrations 436 typically provided on one surface of the tie strap 44 so as to facilitate locking in the tie head 36. The centerlines of the wheels 428 and 430 are spaced to compressively pull the strap portion 44 therebetween in a substantially straight path and substantially perpendicular to the centers of the wheels 428 and 430. The idler wheel 430 may be biased as by a spring 438 for greater compression between the wheels 428 and 430 or the idler wheel 430 may also be coupled to be positively driven simultaneously with the wheel 428. In a preferred embodiment shown in FIG. 24*b*, a tie guiding member 440 with a curved surface portion 442 is disposed opposite the driving wheel 428. The curved surface portion 442 is formed to have a curvature conforming to that of the driving wheel 428. The member 440 is spaced from the driving wheel 428 so as to compressively receive the tie strap portion 44 therebetween. The curved surface portion 442 serves as a track about the wheel 428 for causing engagement of the strap portion 44 with an arcuate portion of the wheel 428 whereby a plurality of teeth engage a plurality of strap serrations 436 for assurance of positive pulling of the tie strap 44 through the tensioning unit 144 and minimization of slippage.

Figure 25A:
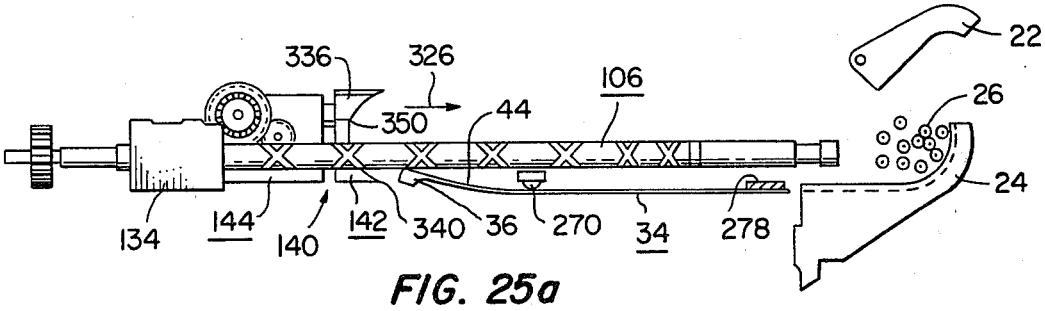

The operation of the feeding mechanism 140 for positioning a tie 34 about a wire bundle, tensioning the tie and severing the tie at a predetermined tension may be more fully understood now with reference to FIGS. 25*a* through 25*e*. In FIG. 25*a*, the tie 34 is shown diagrammatically in its feeding position, positioned as set forth hereinabove in the "twelve o'clock" position within a groove 66 on top of the drum 56, such groove 66 being substantially parallel to and axially aligned with the stroke path 326 of the feeding mechanism 140. The tie head 36 is in its lifted position, the spring loaded tie holder 270 holding the tie strap 44 with radial pressure in place in the groove 66 more proximate the head 36. The retainer 278 keeps the tail portion of the tie strap 44 in the groove 66 near the hook end. The upper and lower hooks 22 and 24, respectively, are open for receiving therein a plurality of wires 26 to be bundled. The feeding mechanism 140, as driven by the carriage 134 on the rotating shaft 106, moves forward in its stroke path 326 with the bottom edge 340 of the threading block member 336 positioned to engage and lift the tie head 36.

Figure 25B:
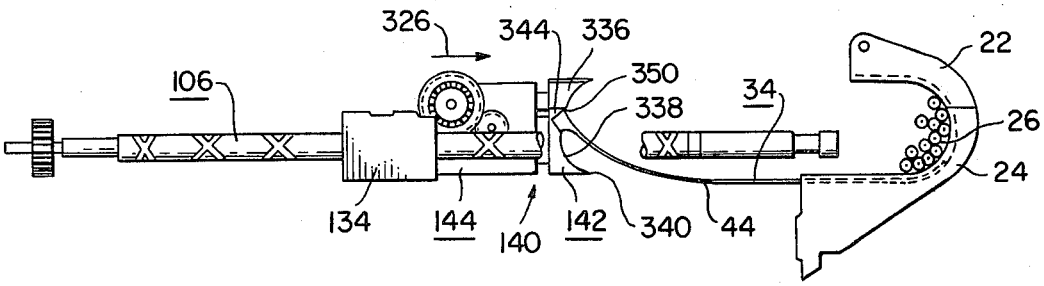

In FIG. 25*b*, continued forward movement closes the hooks 22 and 24 as set forth hereinabove. As shown, the bottom edge 340 has engaged and lifted up the tie head 36, to the curved surface 338 of the threading block member 336, whereon with continued forward movement of the feeding mechanism 340, the tie head is slidably guided upwardly along the curved surface 338 to the tie seat 344, whereat the upward movement of the head 36 is stopped by the stop 350. During this upward movement of the head 36, the tie holder 270 holds the strap 44 in the groove 66 and with the radial pressure applied thereto, prevents the tie 34 from undesirably sliding axially in the groove 66 under the influence of the axially moving feeding mechanism 140. Upon continued movement of the feeding mechanism 140, the tie head 36 is properly seated in the seat 344, the strap portion 44 adjacent the head engages the slot 342 in the surface 338 in the threading block member 336 and the front rocker arm 274 supporting the tie holder 270 is pivotally, laterally pushed clear of the stroke path 326 by the threading block member 336, as described with respect to FIG. 17. Other tie holding mechanisms may be provided for holding the tie head 36 suitably seated in the seat 344 and the strap portion 44 in the slot 66 during continued movement of the tie feeding mechanism 140. Such holding mechanisms may include a spring loaded finger member (not shown), for example, that is suitably mounted in the housing 12 and extends laterally over the top groove 66 to maintain the tie strap portion 44 in proper position. Such a finger member may be engageable by the threading block member 336 and moveable longitudinally therewith. The finger member may be arranged to gradually laterally move away from the groove 66 during such longitudinal movement such that by the time the feeding mechanism 140 is near its end of the forward stroke such finger member is laterally clear from the groove 66.

Figure 25C:
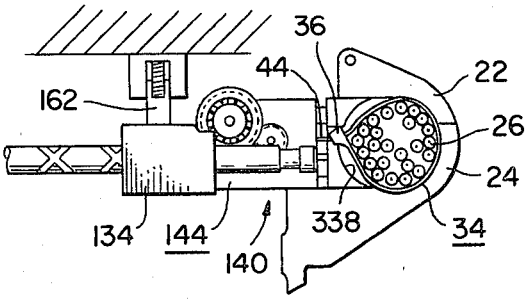

With continued movement of the feeding mechanism 140 as shown in FIG. 25*c*, the tie 34 is fed, tail portion first, into the track of the lower hook 24, where the tie 34 is guided therearound into the track of the upper hook 22 where the tail end completes the circumferential loop about the wire 26 and threads itself through the aperture 48 in the tie head 36. By the time the tail end of the tie reaches the driving wheel 428 and idler wheel 430 for tensioning thereby, the clutch 122 has been suitably actuated to drive the driving wheel 428 and the movement of the carriage 134 has been interrupted by the detent 162. Thus, during the tensioning of the strap 44 by the wheels 428 and 430 and the severing of the strap 44 by the severing mechanism 362, the tensioning unit 144, connected to the carriage 134, is stationary. The high rotational speed of the driving wheel 428 as described hereinabove allows for suitable tie tensioning and severing in a period of time shorter than the period of time of carriage movement interruption. It should be noted that the distance the tie strap 44 travels around the wires 26 is not determined by the size of the wire bundle but by the distance around the hooks 22 and 24 and the curved surface 338 that guide its travel. Thus, with the tie length being fixed, tensioning of the strap portion 44 by the wheels 428 and 430 begins at approximately the same position on each strap 44 as it is threaded between the wheels 428 and 430.

Figure 25E:
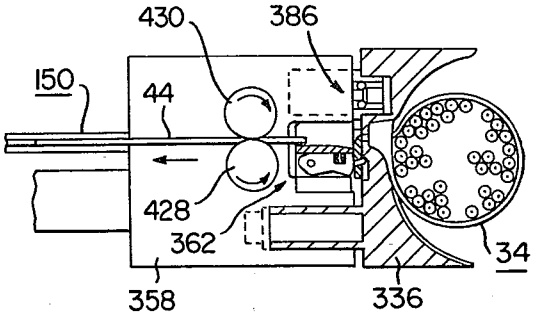
Figure 25D:
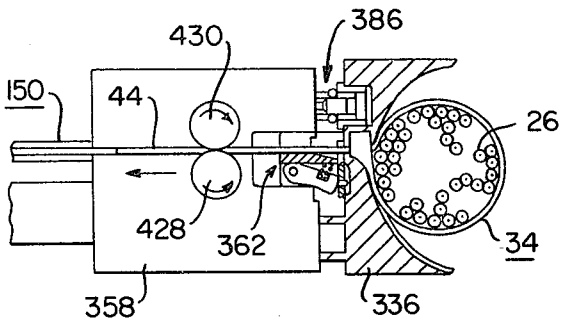

FIG. 25*d* shows the details of tie 34 being tensioned around the wires 26 by the wheels 428 and 430 before the predetermined tension has been reached in the tension sensing device 386 and thus prior to actuation of the tie strap severing mechanism 362. FIG. 25*e* shows the relationship of the threading block member 336 to the tensioning block member 358 and the actuation of the severing mechanism 362 upon reaching and exceeding the predetermined tension as set in the tension sensing device 386. At this point, the excess strap portion 44 is severed adjacent the tie head 36, the wires 26 being bundled at a desired tension by the bundling tie 34, suitably locked thereon. The severed strap portion 44 is propelled by the rotating wheels 428 and 430 into the scrap ejector mechanism 150 for ejection.

Turning now to FIGS. 26, 27, 28 and FIG. 11, the details of the scrap ejector mechanism 150 may be appreciated. The ejector mechanism 150 comprises a plurality of elongate, hollow tubes 444, 446, 448, 450 and 452, interlocked together for telescopic, collapsible movement. Although five tubes are shown in the preferred arrangement, it should be understood that any other number of tubes, with at least two, may be used. Each of the tubes from the tube 444 to the tube 452 has a successively increasing outer diameter. The outer diameter of each of the tubes, except the largest tube 452, is formed to have a close sliding fit with the inner diameter of the succeeding tube. Thus, tube 444 slides closely within tube 446, and tube 446 within tube 448 and so on.

Tubes 446, 448 and 450 have at the tube receiving ends radially projecting abutments 454, 456 and 458 respectively, serving as stops for the succeeding tubes thereon. Tube 444 has a spacer 460 serving as a stop for the tube 446 and as a means for pushing the tubes into a completely collapsed condition. As the tubes are collapsed, the spacer 460 engages the tube 446, abutment 454 engages the tube 448, abutment 456 engages the tube 450 and abutment 458 engages the largest tube 452. A completely collapsed mechanism 150 is shown in FIG. 27. The tube lengths are formed such that the tube ends of the completely collapsed mechanism 150 at the discharge end 462 extend closely adjacent to an end plane 464. As defined in this context, the term "closely adjacent to" includes the positions wherein the ends of the tubes at the mechanism end 462 are at, closely interiorly within the end plane 464 or closely exteriorly beyond the end plane 464. For example, in the preferred embodiment, the lengths of the tubes 446, 448, 450 and 452 are formed to be approximately the same. The abutments 454, 456 and 458 are formed to have small axial extents, on the order of mils, so that when the tubes are collapsed, the tube ends at mechanism end 462 will be slightly staggered but, nevertheless, closely adjacent to the end plane 464 as shown in FIG. 27. It should be appreciated that the lengths of the tubes may be formed to compensate for the axial extent of the abutments, whereby all the tube ends will be in a substantially common plane at the plane 464. The smallest tube 444 has an axial extent 466 between the spacer 460 and the succeeding tube 446 such that the interlocked end of the tube 444 is closely adjacent to end plane 464 in the collapsed mechanism. Thus, other than an opening 468 extending through the tube 444, the tubes in the collapsed condition at the end 462 define, with close fitting interfaces, a substantially solid cross-section thereat.

As shown in FIG. 28, the opening 468, extending lengthwise throughout the tube 444, is preferably rectangular and adapted to closely receive therethrough the excess tie strap portion 44 that is severed in the tensioning unit 144, illustrated in FIG. 11. The tube 444 is provided with a flange 470 for connecting the tube 444 to the tie feeding mechanism 140 such that the opening 468 is positioned to receive the excess tie strap 44 upon being severed. As shown in FIG. 11, the ejector mechanism 150 is mounted in the tool with the largest tube 452 suitably stationarily affixed to the housing and opening into an aperture 472 of a housing port 474 at the tool rearward end 15. The smallest tube 444, being connected to the feeding mechanism 140 is moveable therewith. Upon linear forward movement of the feeding mechanism 140, the ejector mechanism 150 is extended telescopically and upon reverse movement of the feeding mechanism 140, the ejector mechanism 150 is collapsed telescopically.

In operation, the tie strap 44 is severed while the feeding mechanism is temporarily stationary at the forward end 20 of the housing and the ejector mechanism 150 is thereby extended. Due to the high velocity of the tie tensioning mechanism, as the strap is severed it is thrust into the opening 468 and therethrough where it may or may not be propelled through the port opening 472. Should the severed excess strap portion be stopped within one of the tubes, having exited the opening 468, the strap portion will be pushed out the port opening 472 by the collapsing tubes during reverse movement, which effectively form a solid wall when collapsed as described herein. Should the strap portion fail to exit the opening 468, upon severing of the subsequent tie strap, the subsequent scrap portion will push the first scrap portion out the opening 468, as the rectangular opening is restricted to axially receive and contain only one tie strap at a time.

Referring now to FIGS. 1 and 29, the details of the scrap container assembly 14 are shown. As described hereinabove, the excess tie strap portion having been tensioned and severed is ejected from the tool housing through the opening 472 in the housing port 474. Due to the high rotary speeds at which the ties are tensioned, it is often common for the tie scrap portions to be propelled through the opening 472. The scrap container assembly 14 has provision for deflecting and collecting the expelled tie portions and also for preventing feedback of expelled ties to the port opening 472 so as to prevent clogging or jamming of the tool 10. The assembly 14, as illustrated in FIG. 29 comprises an upper deflector portion 472 with a curved section 478 adapted to be struck by the expelled ties and deflected downward thereby.

Within the deflector portion 476 is a hollow tie anti-clogging member 480 preferably of generally cylindrical configuration. The anti-clogging member 480 has a coupling portion 482 adapted to be coupled to the housing port 474, preferably by screw threads. Adjacent the coupling portion 482 is a hollow elongate tubular portion 484 having a plurality of longitudinally extending slots 486 extending through its walls. The slots 486 may extend partially into and through the coupling portion 482. The slots 486 are formed to have a width slightly greater than the width of the tie strap portion 44. In the preferred arrangement, three slots 486 are provided, one of the three slots being oriented at the bottom of the member 480 when coupled to the port 474 and the other two slots 486 each being mutually spaced about ninety degrees from the bottom slot in opposite directions therefrom and extending within a common plane. It has been found that in such a structure the tie scraps are permitted to pass radially through the narrow slots 486 or longitudinally out the open end of the hollow tubular portion 484 during ejection while being prevented from returning to and clogging the ejection area, regardless of tool orientation. Scrap tie portions discharged through the slots 486 or out through the open end of the tubular portion 484 may fall therefrom or, depending upon their discharge velocity, be propelled to strike the walls of the deflector portion 476 for deflection downwardly.

The container assembly 14 includes a collector 488 that is removably attached to the deflector portion 476. Preferably, the collector 488 has a key portion 490 adapted to snap or slide onto a keyway 492 in the deflector portion 476 for securement thereto. The collector 488 has an open surface area 494 for communication with the interior of the deflector portion 476 and an open side area 496 that is enclosed by a wall 498 of the deflector portion 476' in assembly. The collector 488 receives and holds therein tie scraps that are deflected from the deflector portion 476 upon ejection from the port 472. When the collector 488 is filled with scrap portions, it may be removed from the deflector portion 476 for disposal of the scrap. The tool 10 may also be operated without the collector 488, utilizing the deflector portion 476 to deflect ejected scrap portions away from an operator. However, in a preferred arrangement, the wall 498 may be used to hold within the housing a removable member for coupling the motor shaft to the motor gear 102 (FIG. 3) such that if the wall 498 were removed as by detachment of the deflector portion 476, the coupling member would become free and ultimately separated from the tool, rendering the tool inoperable. In the preferred embodiment, both the deflector portion 476 and the collector 488 are made of clear plastic material to provide a visual inspection of the scrap ejection and collection.

Referring to FIG. 30, electrical control system 112 is comprised of several functionally distinct sections. A triggering section includes monostable circuit 502, the customary input to which is provided by operation of trigger 18 (FIG. 1) and accompanying closure of trigger switch 504. A drive section is responsive to the triggering section and has driver circuit 506 and power transistor group 508. Mechanical drive is furnished by dynamically braked motor section 510. Limit control unit 512 and tie interlock unit 514 operate respectively in informing the tool control system of cycle progress and of tool tie content.

Considering monostable circuit 502, voltage V+ defines a system HI signal level and electrical ground (zero volts) defines a system LO signal level. Upon momentary closure of switch 504, a negative-going, (HI to LO) trigger signal is applied over line 516 to the SET terminal of unit 502.

In this connection, line 518 is connected to ground potential through unit 512, such LO signal being applied to the upper plate of capacitor $C_5$ and giving rise to the negative-going triggering signal. Unit 502 is responsive to the triggering signal to provide an output pulse for a period of five hundred miliseconds, thus providing a HI on line 520 during that time period. Driver circuit 506 is activated by the HI condition of line 520 to provide a HI on output line 522. Power transistors $T_1$, $T_2$ and $T_3$ are connected in parallel and are rendered conductive by the HI state of line 522. Line 524 is accordingly rendered LO, by conducting to ground through power transistors $T_1$, $T_2$ and $T_3$. On this occurrence, diode $D_1$ of motor section 510 is rendered conductive, motor drive voltage (DC) being a positive voltage selected in accordance with motor 526 characteristics.

In the course of operation of motor 526, magnet 286 above discussed is displaced into a position overlying Hall-effect switch 288. At this juncture, line 582 is released from ground potential as is line 530. With line 530 free of ground potential, driver 506 maintains line 522 HI beyond the five hundred milisecond period provided by the HI condition of line 520 due to initial triggering. Motor 526 accordingly continues operation throughout the time period in which the magnet 286 overlies Hall-effect switch 288. This cumulative time period of motor operation is approximately one and one half seconds.

At a further point in operation of the tool, magnet 286 departs from its overlying relation to switch 288, whereupon line 530 is again returned to ground potential by switch 288 being again conductive to ground. Driver circuit 506 is thus disabled and a single cycle of tool operation is completed. Should trigger switch 504 be retained in closed position, the tool will recycle, since the ground condition of line 528 would then be applied through line 518 to triggering line 516.

By way of a dynamic braking of motor 526 upon completion of a tool cycle, SCR 536 has its control electrode coupled by capacitor $C_8$ and resistor $R_1$ to the terminals of motor 526. As the motor functions as a generator during coastdown, diode $D_1$ is forward biased. SCR 536 is rendered conductive by the generator output voltage and thereupon serves to effectively short the generator output and discontinue rotation of motor 526. Diode $D_2$ is included for protection against inductive kickback during motor operation.

Referring again to tie interlock unit 514, switch 88 above discussed is shown in its condition wherein tie reloading is required. As the switch 88 reaches this condition, i.e., upon the pulling of lever arm 78 away from actuator 86, a ground connection is made directly to lamp 33 for illumination thereof. Likewise, line 532, which is connected to the reset input of monostable circuit 502, goes from a HI state to a LO state thus providing a resetting trigger to monostable circuit 502. For so long as line 532 remains at ground potential, operation of triggering switch 504 is ineffective to provide an output from circuit 502 to initiate tool cycling. Upon loading ties into the tool, the condition of switch 88 reverts from that indicated in FIG. 30 to its opposite state, releasing the ground on line 532 and permitting tool operation. An external trigger may be applied to lines 534 with equivalent function as the closing of switch 504 where it is desired to operate the system from a remote source.

By way of specific example of circuitry for use in the FIG. 30 system, the circuit 502 may comprise a 555 Signetics timing chip, driver circuit 506 may comprise an Interdesign MOC1902 8 PIN DIP, transistors $T_1$–$T_3$ may be Siliconix VN 66AF, switch 288 may comprise a Micro Switch Hall Chip 612SS4 4 PIN DIP and switch 88 may comprise a Cherry Switch number E63-00A miniature snap acting switch. The motor 526 may be a TRW Globe Motor, Type EM-15 d.c. gearmotor. Resistance values are: $R_1=10$ Kilohms, $R_2=1$ Megohm, $R_3=1.2$ Kilohms, $R_4=1$ Megohm, $R_5=100$ Kilohms, $R_6=100$ Kilohms, $R_7=15$ Kilohms. Capacitance values are: $C_1=0.01$ microfarads, $C_2=0.1$ microfarads, $C_3=0.47$ microfarads, $C_4=0.47$ microfarads, $C_5=0.47$ microfarads, $C_6=0.01$ microfarads, $C_7=0.47$ microfarads, $C_8=0.01$ microfarads.

Having thus described the particular details of the tool mechanisms and structure, a complete cycle will be set forth so that the overall operation of the automatic, power-operated bundling tie applying tool 10 may be fully appreciated.

The description of the operating cycle commences with the tool 10 having been suitably connected to a power source and suitably loaded with a supply of bundling ties 34, the tie 34 being positioned on top of the drum 56 for feeding to the articles to be bundled, as shown in FIG. 3. With this tie 34 in position there are five succeeding ties 34 supported on the drum 56 for further advancement as shown in FIG. 18. The two ties 34 successive to the tie 34 in the top groove 66 have already been separated from the series, the next three still being interconnected by the webs 38. In this inoperative condition, the tie feeding mechanism 140 in FIG. 3 is in the back position of its stroke at the rearward end 15 of the housing 12. The upper hook 22 is in the open position as shown in FIG. 20*a* to permit a bundle of wires 26 to be inserted between the hooks 22 and 24.

Upon depressing the trigger 18, a signal will be transmitted from the main electrical circuit 112 to energize the motor 100. The motor 100 drives the rotary shaft 106 causing the tie feeding mechanism 140 to begin forward movement in its reciprocating stroke path as shown in FIG. 25*a*. As the feeding mechanism 140 moves forwardly therealong, the threading block member 336 engages the lifted tie head and guides the head 36 upwardly into the tie seat 344. Continued movement of the feeding mechanism 140 causes the surface 334 on the threading unit 142 to engage the cam surface 328 on the locking arm 320 as shown in FIG. 20*c* thereby releasing the latch 322 from the collar 292. The released collar 292 and the rod 282 attached thereto are urged forwardly under the influence of the spring 294 thereby pivoting the upper hook 22 to form, with hook 24, a closed loop around the wires 26 as shown in FIG. 1. As the rod 282 moves forwardly, the magnet 286 moves therewith to a position adjacent the switch 288 for actuation thereof. The actuated switch 288 provides a signal to the circuit 112 to control the completion of the cycle until the switch 288 is deactuated, whereby during the cycle further depression of the trigger 18 will not interrupt tool operation.

Continued forward movement of the feeding mechanism 140 causes engagement of the threading block member 336 with the front arm 274 of the rocker arm 272, the front arm 274 supporting the tie holder 270 that applies radial pressure to the tie strap 44 to hold it within the groove 66 until the tie head is properly seated. The front arm with the holder 270 thereon is pushed pivotally laterally clear of the stroke path by the threading block member 336. With this movement, the rear arm 276 is pushed laterally into the stroke path at a location behind the moving feeding mechanism 140.

Continued forward movement of the feeding mechanism 140 feeds the tie 34, tail first, into and around the hooks 22 and 24, threadably through the aperture 48 and into the tensioning unit 144 as shown in FIGS. 25*b* and 25*c*. By the time the strap portion 44 reaches the wheels 428 and 430 for tensioning the strap 44, the bevel gear 156 on the tensioning unit 144 has engaged the bevel gear 130 on the clutch mechanism 122 and has coupled the clutch mechanism to drive the rotary driving wheel 428. Also at this point, the detent 162 has releasably engaged the carriage 134, interrupting movement of the feeding mechanism 140 as shown in FIG. 14*b*. As the feeding mechanism 140 is temporarily stationary, the wheels 428 and 430 grasp the strap portion 44, apply tension thereto and when the predetermined tension in the strap portion 44 is sensed by the tension sensing device 386, the severing mechanism 362 is actuated to sever the strap portion 44 adjacent the head 36 is depicted in FIGS. 25*d* and 25*e*. The excess strap portion is propelled by the rotary wheels 428 and 430 into the ejector mechanism 150 for ejection into the container assembly 14.

Upon severance of the strap portion 44, the rudder 172 in the carriage 134 has reversed direction under the influence of the spring 176 and the carriage 134 and thereby the feeding mechanism 140 are released from the detent 162 and driven in a rearward direction. In the rearward movement, the tensioning block member 358 engages the back rocker arm 276 laterally clearing it of the stroke path and thereby laterally pivoting the front arm 274 and thereby the tie holder 270 into the stroke path in the wake of the rearwardly moving feeding mechanism 140 and in position over the vacant groove 66. Upon continued rearward movement, the cam surface 236 engages the pin 226 of the indexing mechanism 60 for actuation thereof as shown in FIG. 15. Upon actuation of the indexing mechanism 60, the drum 56 is rotated incrementally for thirty-six degrees, moving simultaneously the next tie 34 to the feeding position, the next web 38 in position to be cut and a new tie 34 into the loading position at the bottom of the drum 56 from the tie feed in the compartment 40.

Continued rearward movement of the feeding mechanism causes engagement of the block member 358 with the actuating lever 262 for actuating the cutting mechanism 246, thereby rotating the knife 248 and cutting the tie web 38. During this movement, the trailing surface 332 of the threading unit 142 as shown in FIG. 20*b* engages the collar 292, drawing the rod 282 rearwardly, opening the hook 22 and causing the latch 322 to hold the collar 292 in a locked position. With the rearward movement of the rod 282, the magnet 286 is moved rearwardly away from the switch 288 thereby deactuating the switch, de-energizing the motor 100 and terminating operation of the tool. At this point, the carriage 134, under the influence of the spring 191, has reversed, or is in a position to reverse, direction for forward movement. Movement of the feeding mechanism 140 in the rearward direction collapses the scrap ejector mechanism 150, pushing tie scraps that may be contained therein into the container assembly 14 for collection.

When the bottom groove 66 at the loading position is empty, the lead tie 34 of a new supply of interconnected ties may be loaded into the tool by insertion of the head into the tie loading mechanism 54 until positioned in the bottom groove. In a preferred arrangement, a visual light indicator 33 as shown in FIG. 1 will be actuated when the bottom groove 66 is vacant. An audible signal may also be provided with, or in place of, the visual indicator 33. The tool 10 may also be rendered inoperable until the tool is reloaded with another tie in the loading groove 66. It should be appreciated that loading an empty tool wherein no ties are on the tie carrier, such as, for example at the beginning of use requires insertion of the lead tie into the leading mechanism 54 and then the firing of five "blanks" to index the drum 56 and thereby the lead tie into the feeding position.

The bundling tie applying tool in accordance with the present invention as described herein has several desirable features and operational advantages. The tool is lightweight, on the order of three and one half pounds, completely portable and capable of use with an alternating current power source or battery pack. The cycle time of operation is rapid, less than about one and one half seconds, suitable for high production requirements. The design of the tool is compact for ease of handling and the tool is capable of applying ties to a bundle of wires having a wide range of diameters up to about 1.20 inch. Tie loading is simple and requires no special handling. Moreover, tie application is effected without regard to tool orientation.

Having described the preferred embodiments of the bundling tie applying tool, it should be appreciated that various modifications may be made without deviating from the contemplated scope of the invention. For example, although the tool is used in the preferred embodiment to receive ties interconnected between heads that are subsequently separated by the tool, the tool may also be used to receive separated ties on an individual basis. Moreover, the tool may also be semi-automatically operable or manual.

Although a desirable advantage of the tool 10 is for portable application as shown and described herein, the tool is not so limited. The tool may be mounted for bench applications or other assembly area uses whereby containment of a fixed quantity of ties is not necessary. In such non-portable use, a series of ties interconnected between heads may be fed into the tool from an endless source suitably held on the bench, by the operator or other external support means. Such a supply may comprise a continuous sheet of interconnected ties that may be flat or rolled.

It should also be appreciated that while the power source in the preferred embodiment of the tool is an electric motor that other power sources, such as a fluid actuated motor may also be used. Also, while each complete cycle for applying a single tie is actuated in the preferred embodiment by a depression of the trigger, the electric circuit 112 may be modified with additional switching means for continuous operation or for application of a specific number of ties.

Various other changes to the foregoing, specifically disclosed embodiments and practices will be evident to those skilled in the art. Accordingly, the foregoing preferred embodiments are intended in an illustrative and not in a limiting sense. The true spirit and scope of the invention are set forth in the following claims.

What is claimed is:

1. Apparatus for applying to a plurality of articles to be bundled an elongate, flexible bundling tie having a head and a strap portion from a succession of such bundling ties interconnected between adjacent heads by a web, comprising:

a housing;

means supported in said housing for receiving said interconnected ties individually from said succession of bundling ties;

means for advancing said ties from said receiving means to a separating station;

means at said separating station for cutting the web between said tie heads to thereby provide separated, individual ties;

means for positioning an individual tie in a closed loop about said articles to be bundled; and means for tensioning said tie about said articles.

2. An apparatus according to claim 1, wherein said advancing means comprises a movable elongate member.

3. An apparatus according to claim 2, wherein said elongate member includes a generally cylindrical, rotatable tie carrier having a plurality of longitudinally extending slots thereon for receiving and individually supporting said ties therewithin.

4. An apparatus according to claim 2, wherein said receiving means comprises tie loading means adjacent said elongate member for laterally transferring ties individually thereto and positioning ties individually thereon.

5. An apparatus according to claim 4, wherein said tie loading means comprises guide means defining a passageway for passage of an individual tie head.

6. An apparatus according to claim 5, wherein said guide means includes resilient support means for holding a tie on said elongate member.

7. In a tool for applying to a plurality of articles to be bundled an elongate, flexible bundling tie having a strap portion at one end and an apertured head portion at the other end from a series of such bundling ties interconnected in succession by a web between adjacent head portions, apparatus comprising:

a housing;

rotatable tie carrier means supported in said housing for supporting a plurality of bundling ties;

means for receiving said interconnected ties individually from said succession of bundling ties and for positioning individually said ties on said tie carrier means;

means for rotating said carrier means and thereby said ties thereon from said receiving means to a separating station; and means at said separating station for cutting the web between tie heads to thereby provide separated ties for individual application to said articles.

8. A power-operated tool for installing around a plurality of articles to be bundled an elongate, flexible bundling tie having a head portion and a strap portion from a feed of such bundling ties interconnected in succession by a web between adjacent head portions, comprising:

a tool housing;

a movable tie carrier mounted in said housing, said carrier including a plurality of bundling tie supports;

means for receiving said interconnected ties individually in succession from said feed of bundling ties and for positioning individually said ties on said tie supports;

power means for moving said tie carrier and thereby said ties thereon from said receiving means to a separating station;

means at said separating station for cutting the web between tie head portions to thereby provide separated, individual ties;

means for positioning an individual tie in a closed loop about said articles to be bundled; and means for tensioning said tie about said articles.

9. A tool according to claim 8, further including electric circuit means for controlling operation of said tool.

10. A tool according to claim 9, wherein said power means includes an electric motor connected to said circuit means.

11. A tool according to claim 10, further including trigger means coupled to said circuit for energizing said electric motor to commence operation of said tool and cycle control means connected to said circuit means and operable after energization of said electric motor for electrically overriding said trigger means to thereby control operation of said tool.

12. A tool according to claim 11, wherein said cycle control means includes means for terminating operation of said tool upon application of an individual tie.

13. A tool according to claim 12, wherein said cycle control means includes means movable from a first position to a second position to actuate said cycle control means.

14. A tool according to claim 13, wherein said cycle control means includes switch means.

15. A power-operated tool for applying to a plurality of articles to be bundled an elongate, flexible bundling tie having a head portion and a strap portion from a succession of such bundling ties interconnected between adjacent head portions of a web, comprising:

a tool housing;

an elongate rotatable tie carrier rotatably mounted in said housing, said carrier including a plurality of tie supports extending longitudinally on said carrier;

means for receiving said interconnected ties individually from said succession of bundling ties and for positioning individually said ties on said supports;

a member supported in said housing and capable of reciprocating therein in a direction substantially parallel said tie supports;

power means for driving said reciprocable member;

means responsive to the movement of said member for rotating said carrier from said receiving means to a separating station;

means responsive to the movement of said member for cutting as said separating station the web between tie heads to thereby provide separated, individual ties;

means responsive to the movement of said member for positioning an individual tie in a closed loop about said articles to be bundled;

means for tensioning said tie about said articles; and means for severing the strap portion of said tie tensioned about said articles.

16. A tool according to claim 15, wherein said rotatable tie carrier comprises a generally cylindrical drum and wherein said tie supports comprise a plurality of grooves for accommodating the strap portions of said ties individually therein.

17. A tool according to claim 16, wherein said grooves are spaced substantially equally about the periphery of said drum.

18. A tool according to claim 16, wherein said rotating means comprises means for rotatably indexing said drum, said indexing means being responsive to the movement of said reciprocable member.

19. A tool according to claim 18, wherein said indexing means comprises means for rotatably advancing said drum and thereby said grooves in substantially equal increments.

20. A tool according to claim 15, wherein said driving means comprises an electric motor.

21. A tool according to claim 20 wherein said driving means includes a rotary shaft for reciprocating said reciprocable member, said shaft being coupled by gear means to said electric motor, said shaft extending longitudinally within said housing and substantially parallel to said rotatable carrier.

22. A tool according to claim 21, wherein said rotary shaft has about its periphery an axially extending right-handed helical groove and an axially extending left-handed helical groove, the grooves meeting at each end in a grooved termination and wherein said reciprocable member includes means for engaging said grooves individually and for changing grooves at said respective end terminations, whereby upon rotation of said rotary shaft said reciprocable member is driven axially back and forth therealong.

23. A tool according to claim 20 wherein said tensioning means includes a rotary driving member engageable with a strap portion of said tie and including means for selectively coupling said rotary driving member to said driving means.

24. A tool according to claim 23, wherein said coupling means includes selectively engageable clutch means.

25. A tool according to claim 24 wherein said clutch means includes means responsive to the movement of said reciprocable member for causing engagement of said clutch means.

26. A tool according to claim 23, wherein said tensioning means is on said reciprocable member for reciprocable movement therewith.

27. A tool according to claim 26 further including means for interrupting axial movement of said member for a predetermined period of time during rotation of said shaft.

28. A tool according to claim 27, wherein said severing means is on said reciprocable member for reciprocable movement therewith.

29. A tool according to claim 28, further including tension sensing means for restraining actuation of said severing means until a predetermined tension is sensed.

30. A tool according to claim 29, wherein said tension sensing means includes means movable at a predetermined tension, said severing means including means responsive to the movement of said movable means for actuating said severing means.

31. A tool according to claim 30, wherein said interrupting means comprises means positioned on said housing for releasably holding said reciprocable member in a stationary axial location during the selective coupling of said rotary driving member to said driving means and during actuation of said severing means.

32. A tool according to claim 31, wherein said interrupting means includes means for engaging releasable detent means supported on said housing.

33. A tool according to claim 20, wherein said positioning means includes selectively operable hook means.

34. A tool according to claim 33, wherein said hook means comprise two hooks, one of which is movable with respect to the other to an open position to allow entry therebetween of articles to be bundled and to a closed position defining with said other hook a closed loop therearound said articles.

35. A tool according to claim 34, wherein said hook means comprises a movable rod extending longitudinally of said housing and coupled to said movable hook, said movable rod including means selectively engageable by said reciprocable member for moving said rod from a first position wherein said movable hook is in a closed position to a second position wherein said movable hook is moved to an open position.

36. A tool according to claim 35, further including means for selectively releasably locking said rod in said second position whereby said movable hook is locked in the open position.

37. A tool according to claim 36, wherein said locking means includes means responsive to the movement of said reciprocable member for effecting release of said rod from said second position.

38. A tool according to claim 37, wherein said means for effecting release comprises a locking member pivotally coupled to said housing, said member including thereon a cam surface for engaging said reciprocable member to thereby pivot said locking member away from said engageable means on said rod.

39. A tool according to claim 34, wherein said positioning means further includes a threading member on said reciprocable member for movement therewith, said threading member having a forwardly facing curved surface and a seat therein for receiving and supporting a tie head therein, said threading member upon forward reciprocating movement of said reciprocable member being capable of pushing an individual tie, strap portion first, into and around said hooks and threadably through an aperture in the tie head portion to thereby form said loop about said articles.

40. A tool according to claim 20, further including circuit means for energizing said electric motor.

41. A tool according to claim 40, wherein said circuit means includes cycle control means and switch means responsive to the movement of said reciprocable member for actuating and deactuating said cycle control means.

42. A power-operated tool for applying an elongate, flexible bundling tie having a head portion and a strap portion around articles to be bundled from a feed of such bundling ties interconnected in succession by a web between adjacent head portions, comprising:

a tool housing;

movable tie carrier means supported on said housing and including a plurality of tie supports;

means for receiving said interconnected ties individually in succession from said feed of bundling ties and for positioning individually said ties on said supports on said carrier means;

means on said housing for holding said feed of interconnected bundling ties, said holding means being disposed adjacent said receiving means for transfer of ties thereto;

power means for moving said movable tie carrier means and thereby said tie supports from said receiving means to a separating station;

means at said separating station for cutting the web between adjacent tie head portions to provide thereby separated, individual application ties;

means for positioning an individual tie in a closed loop about said articles to be bundled;

means for tensioning said tie about said articles; and means for severing the strap portion of said tie tensioned about said articles.

43. A tool according to claim 42, wherein said moving means includes means for moving said tie carrier and thereby said tie supports from said separating station to a feeding station whereby separated ties are moved individually to such feeding station.

44. A tool according to claim 43, further including feeding means at said feeding station for feeding a separated tie to a position adjacent said articles to be bundled.

45. A tool according to claim 42, further including means for ejecting a severed tie portion from said tool.

46. A portable tool according to claim 42, wherein said power means comprises an electric motor.

47. An article harnessing tool for applying elongate cables ties circumferentially to such article with preselected tension engagement therewith:

an elongate housing;

receiving means for supporting a plurality of such cable ties in said housing, each tie being spaced laterally relative to an adjacent tie and in alignment with such tool longitudinal axis and movable collectively in such alignment to present said ties individually in sequence to an application station in said housing; and applying means for advancing such ties individually from said application station into such circumferential relation to said article and for applying such preselected tension thereto.

48. In an apparatus for applying a bundling tie to articles to be bundled:

drive means;

movable carriage means driven by said drive means;

actuatable tie tension means supported by said carriage means and movable therewith; and actuation means responsive to the movement of said carriage means for selectively coupling said drive means to said tension means to thereby actuate said tie tension means.

49. The invention according to claim 48, wherein said drive means is continuously operable and wherein said carriage means includes means for providing discontinuous movement of said carriage means during such continuous operation of said drive means.

50. The invention according to claim 49, further including means for interrupting the movement of said carriage means during actuation of said tie tension means.

* * * * *